US007283766B2

(12) United States Patent
Arimitsu et al.

(10) Patent No.: US 7,283,766 B2
(45) Date of Patent: Oct. 16, 2007

(54) PROCESS CARTRIDGE AND IMAGE FORMING APPARATUS

(75) Inventors: Takeshi Arimitsu, Odawara (JP); Minoru Sato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/465,746

(22) Filed: Aug. 18, 2006

(65) Prior Publication Data

US 2006/0285878 A1 Dec. 21, 2006

Related U.S. Application Data

(62) Division of application No. 11/045,046, filed on Jan. 31, 2005, now Pat. No. 7,155,140.

(30) Foreign Application Priority Data

Jan. 30, 2004 (JP) ..... 2004-024324
Jan. 24, 2005 (JP) ..... 2005-016151

(51) Int. Cl.
*G03G 21/16* (2006.01)
*G03G 21/18* (2006.01)

(52) U.S. Cl. ..... 399/111; 399/114

(58) Field of Classification Search ..... 399/111, 399/114

See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,528,341 | A | 6/1996 | Shishido et al. | 355/200 |
| 5,585,889 | A | 12/1996 | Shishido et al. | 355/200 |
| 5,870,654 | A | 2/1999 | Sato et al. | 399/109 |
| 5,911,096 | A | 6/1999 | Batori et al. | 399/111 |
| 5,940,658 | A | 8/1999 | Yokoi et al. | 399/119 |
| 5,946,531 | A | 8/1999 | Miura et al. | 399/111 |
| 5,966,566 | A | 10/1999 | Odagawa et al. | 399/109 |
| 5,974,288 | A | 10/1999 | Sato | 399/119 |
| 6,002,896 | A | 12/1999 | Miyamoto et al. | 399/114 |
| 6,055,406 | A | 4/2000 | Kawai et al. | 399/360 |

(Continued)

FOREIGN PATENT DOCUMENTS

JP 7-104637 4/1995

(Continued)

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

A process cartridge detachably mountable to an electrophotographic image forming apparatus main assembly forms an image on recording material. The cartridge is transportable with the apparatus while being set therein. The cartridge includes a frame, an electrophotographic photosensitive drum, a process device actable on the drum, a shutter movable between an exposing and protecting positions for respectively opening an opening provided in the frame to expose the drum, and closing the opening to protect the drum, and a protecting member interposable between the drum and a transfer roller, provided in the main assembly, for transferring a toner image onto the recording material, upon transportation of the cartridge set in the main assembly together with the main assembly. The protecting member mounts on the frame to cover the shutter. The shutter is movable from the protecting to the exposing positions in interrelation with mounting the cartridge to the main assembly.

5 Claims, 19 Drawing Sheets

U.S. PATENT DOCUMENTS

| | | | | |
|---|---|---|---|---|
| 6,061,538 | A | 5/2000 | Arimitsu et al. | 399/111 |
| 6,075,957 | A | 6/2000 | Batori et al. | 399/114 |
| 6,104,894 | A | 8/2000 | Sato et al. | 399/106 |
| 6,131,007 | A | 10/2000 | Yamaguchi et al. | 399/256 |
| 6,185,390 | B1 | 2/2001 | Higeta et al. | 399/90 |
| 6,188,856 | B1 | 2/2001 | Sato | 399/119 |
| 6,282,390 | B1 | 8/2001 | Miyabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,381,420 | B1 | 4/2002 | Sato et al. | 399/27 |
| 6,459,869 | B2 | 10/2002 | Nittani et al. | 399/111 |
| 6,463,234 | B2 | 10/2002 | Arimitsu et al. | 399/113 |
| 6,640,066 | B2 | 10/2003 | Sato | 399/106 |
| 6,684,041 | B2 | 1/2004 | Yokomori et al. | 399/167 |
| 6,714,749 | B2 | 3/2004 | Sato et al. | 399/102 |
| 6,859,629 | B2 | 2/2005 | Miura et al. | 399/64 |
| 6,895,199 | B2 | 5/2005 | Sato et al. | 399/111 |
| 6,898,399 | B2 | 5/2005 | Morioka et al. | 399/167 |
| 6,934,489 | B2 | 8/2005 | Yokomori et al. | 399/111 |
| 6,937,832 | B2 | 8/2005 | Sato et al. | 399/111 |
| 6,947,686 | B2 | 9/2005 | Kawai et al. | 399/111 |
| 6,968,142 | B2 | 11/2005 | Arimitsu et al. | 399/114 |
| 6,983,114 | B2 | 1/2006 | Arimitsu | 399/114 |
| 7,039,340 | B1 * | 5/2006 | Goebel | 399/114 |
| 2004/0117970 | A1 | 6/2004 | Ogino et al. | 29/464 |
| 2004/0117971 | A1 | 6/2004 | Sato et al. | 29/464 |
| 2004/0190936 | A1 * | 9/2004 | Yoshiyuki et al. | 399/114 |
| 2005/0185984 | A1 | 8/2005 | Arimitsu et al. | 399/114 |
| 2005/0220485 | A1 | 10/2005 | Yokomori et al. | 399/111 |
| 2005/0220486 | A1 | 10/2005 | Miyabe et al. | 399/114 |
| 2005/0244188 | A1 | 11/2005 | Sato et al. | 399/114 |
| 2005/0254862 | A1 | 11/2005 | Toba et al. | 399/284 |
| 2006/0008289 | A1 | 1/2006 | Sato et al. | 399/106 |

FOREIGN PATENT DOCUMENTS

| | | | |
|---|---|---|---|
| JP | 2000-019800 | | 1/2000 |
| JP | 2000019800 | A * | 1/2000 |

* cited by examiner

PROCESS CARTRIDGE AND IMAGE FORMING APPARATUS

CROSS REFERENCE TO RELATED APPLICATION

The present application is a divisional application of parent application Ser. No. 11/045,046, filed Jan. 31, 2005, now U.S. Pat. No. 7,155,140, issued Dec. 26, 2006.

FIELD OF THE INVENTION AND RELATED ART

The present invention relates to a process cartridge which can be left within an electrophotographic image forming apparatus while the apparatus is transported, and an image forming apparatus which can be transported with a single or plurality of process cartridges remaining in the main assembly of the apparatus.

Here, an electrophotographic image forming apparatus is an apparatus which forms an image on a recording medium with the use of one of a plurality of electrophotographic image forming methods. Examples of an electrophotographic image forming apparatus include electrophotographic copying machines, electrophotographic printers (for example, laser printers, LED printers, etc.), facsimile machines, word processors, and multi-functional apparatuses (multi-functional printers, or the like) capable of performing two or more of the functions of the preceding image forming apparatuses.

A process cartridge is a cartridge in which a charging means, a developing means or a cleaning means, and an electrophotographic photosensitive drum are integrally disposed, and which is removably mountable in the main assembly of an image forming apparatus; a cartridge in which at least one among a charging means, a developing means, and a cleaning means, and an electrophotographic photosensitive drum are integrally disposed, and which is removably mountable in the main assembly of an image forming apparatus; or a cartridge in which at least a developing means and an electrophotographic photosensitive drum are integrally disposed, and which is removably mountable in the main assembly of an image forming apparatus.

In the field of an electrophotographic image forming apparatus which employs an electrophotographic image forming method, it has been a common practice to use a system in which an electrophotographic photosensitive member, and a single or plurality of processing means that act on the photosensitive member, are integrated into a unit (processing unit) removably mountable in the main assembly of an image forming apparatus.

As for the method for commercially distributing the main assembly of an electrophotographic image forming apparatus or the abovementioned unit, it has been known that the main assembly of an image forming apparatus, and the processing unit therefor, are individually packaged in their own boxes, or are packaged in the same box, and that the processing unit is placed in the image forming position in the main assembly of the electrophotographic image forming apparatus before the apparatus is put to use for the first time. It has also been proposed to ship an image forming apparatus, with the process unit therefor placed in the main assembly, in order to reduce the size of the box in which the main assembly and unit are placed for shipment, and also, in order to improve the image forming apparatus in shipment efficiency. For example, there has been disclosed an image forming apparatus, which comprises a means (first means) which holds the processing unit in the position in which the processing unit is allowed to perform its function, and a means (second means) which holds the processing unit in the position different from the position in which the processing unit is allowed to perform its function (Japanese Laid-open Patent Application 7-104637).

While a shipment box in which the processing unit and the main assembly of an image forming apparatus are packaged with the processing unit being positioned in the main assembly is transported, the driving force transmitting portion of the processing unit, through which a driving force is transmitted to the processing unit, and the portion of the photosensitive drum (electrophotographic photosensitive member) in the processing unit, which remains in contact with the transfer roller during the shipment, are subjected to vibrations and shocks during the shipment. Thus, a countermeasure for the vibrations and shocks has long been desired.

SUMMARY OF THE INVENTION

The primary object of the present invention is to provide a combination of an electrophotographic image forming apparatus and a process cartridge capable of protecting the electrophotographic photosensitive drum and transfer roller while the combination is transported with the process cartridge being positioned in the main assembly of the image forming apparatus.

Another object of the present invention is to provide an electrophotographic image forming apparatus and a process cartridge capable of protecting the driving force transmitting portion of the main assembly of the image forming apparatus, and the driving force receiving portion of the process cartridge, while the apparatus is transported with the process cartridge being positioned in the main assembly of the image forming apparatus.

Another object of the present invention is to provide a process cartridge and an electrophotographic image forming apparatus, which can be transported with the process cartridge placed in the main assembly of the image forming apparatus, without increasing in size the main assembly of the image forming apparatus, and therefore, which is capable of reducing the amount of such materials as shipment cartons, wrapping sheets, etc., and also, to improve the efficiency with which the combination is transported.

According to an aspect of the present invention, there is provided a process cartridge detachably mountable to a main assembly of an electrophotographic image forming apparatus for forming an image on a recording material. The process cartridge is transportable with the electrophotographic image forming apparatus while being set in the electrophotographic image forming apparatus. The process cartridge comprises a frame, an electrophotographic photosensitive drum, process means actable on the electrophotographic photosensitive drum, a protection shutter movable between an exposing position for opening an opening provided in the frame to expose the electrophotographic photosensitive drum, and a protecting position for closing the opening to protect the electrophotographic photosensitive drum, and a protecting member for interposing between the electrophotographic photosensitive drum and a transfer roller, provided in the main assembly of the apparatus, for transferring a toner image onto the recording material, upon transportation of the process cartridge set in the main assembly of the apparatus together with the main assembly, wherein the protecting member is mounted on the frame to cover the protection shutter such that protection shutter is movable from the protecting position to the exposing position in interrelation with mounting of the process cartridge to the main assembly of the apparatus.

More particularly, the present invention provides a process cartridge which is removably mountable in the main assembly of an image forming apparatus for forming an image on recording medium, and which is transportable in the main assembly of an electrophotographic image forming apparatus, and comprises: a frame, an electrophotographic photosensitive drum, a single or plurality of processing means which act on the electrophotographic photosensitive drum, a protective shutter enabled to take the exposure position (non-protective position) into which it is movable to expose the photosensitive drum, and the protective position into which it is movable to protect the photosensitive drum, a protective member which is attached to the frame of the process cartridge so that as the process cartridge is mounted into the main assembly, it will be placed between the photosensitive drum, and the transfer roller with which the main assembly of the image forming apparatus is provided to transfer a toner image onto the recording medium, in order to protect the photosensitive drum and transfer roller while the image forming apparatus is transported, with the process cartridge placed in the main assembly, and which is structured so that after it is attached to the process cartridge, it allows the protective shutter to be moved from the protective position to the exposure position by the movement of the process cartridge as the process cartridge is mounted into the main assembly.

According to another aspect of the present invention, there is provided an electrophotographic image forming apparatus for forming an image on a recording material, to which a process cartridge is detachably mountable, wherein the electrophotographic image forming apparatus is transportable with the process cartridge set thereto. The apparatus comprises (i) a transfer roller for transferring a toner image onto the recording material, and a process cartridge. The cartridge includes a frame, an electrophotographic photosensitive drum, process means actable on the electrophotographic photosensitive drum, a protection shutter movable between an exposing position for opening an opening provided in the frame to expose the electrophotographic photosensitive drum, and a protecting position for closing the opening to protect the electrophotographic photosensitive drum, and a protecting member for interposing between the electrophotographic photosensitive drum and a transfer roller, provided in the main assembly of the apparatus, for transferring a toner image onto the recording material, upon transportation of the process cartridge set in the main assembly of the apparatus together with the main assembly. The protecting member is mounted on the frame to cover the protection shutter such that the protection shutter is movable from the protecting position to the exposing position in interrelation with mounting of the process cartridge to the main assembly of the apparatus. The apparatus also includes mounting means for mounting the process cartridge, and feeding means for feeding the recording material.

More particularly, the present invention provides an electrophotographic image forming apparatus in which a single or plurality of process cartridges are removably mountable to form an image on recording medium, and which is transportable with the process cartridges mounted therein. The apparatus comprises a transfer roller for transferring a toner image onto the recording medium, and a process cartridge. The cartridge comprises a frame, an electrophotographic photosensitive drum, a single or plurality of processing means which act on the electrophotographic photosensitive drum, a protective shutter enabled to take the exposure position (non-protective position) into which it is movable to expose the photosensitive drum, and the protective position into which it is movable to protect the photosensitive drum, a protective member which is attached to the frame of the process cartridge so that as the process cartridge is mounted into the main assembly, it will be placed between the photosensitive drum, and the transfer roller with which the main assembly of the image forming apparatus is provided to transfer a toner image onto the recording medium, in order to protect the photosensitive drum and the transfer roller while the image forming apparatus is transported, with the process cartridge placed in the main assembly, and which is structured so that after it is attached to the process cartridge, it allows the protective shutter to be moved from the protective position to the exposure position by the movement of the process cartridge as the process cartridge is mounted into the main assembly. The apparatus also includes a conveying means for conveying the recording medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus and process cartridge in accordance with the present invention will be described in detail with reference to the appended drawings.

Embodiment 1

First, the first embodiment of the present invention will be described in detail with reference to drawings.

In the descriptions of the following embodiments of the present invention, the lengthwise direction of a process cartridge means the direction intersecting the direction in which the cartridge is inserted in the main assembly of an electrophotographic image forming apparatus (direction roughly perpendicular to axial direction of photosensitive drum). It is parallel to the surface of the recording medium, and intersects (is roughly perpendicular to) the direction in which recording medium is conveyed. The left and right sides of a process cartridge are the left and right sides of the process cartridge as seen from upstream in terms of the direction in which recording medium is conveyed. The top and bottom surfaces of a process cartridge are the surfaces of the cartridge which face upward and downward, respectively, after the mounting of the process cartridge into the main assembly of an image forming apparatus.

Figure 1:
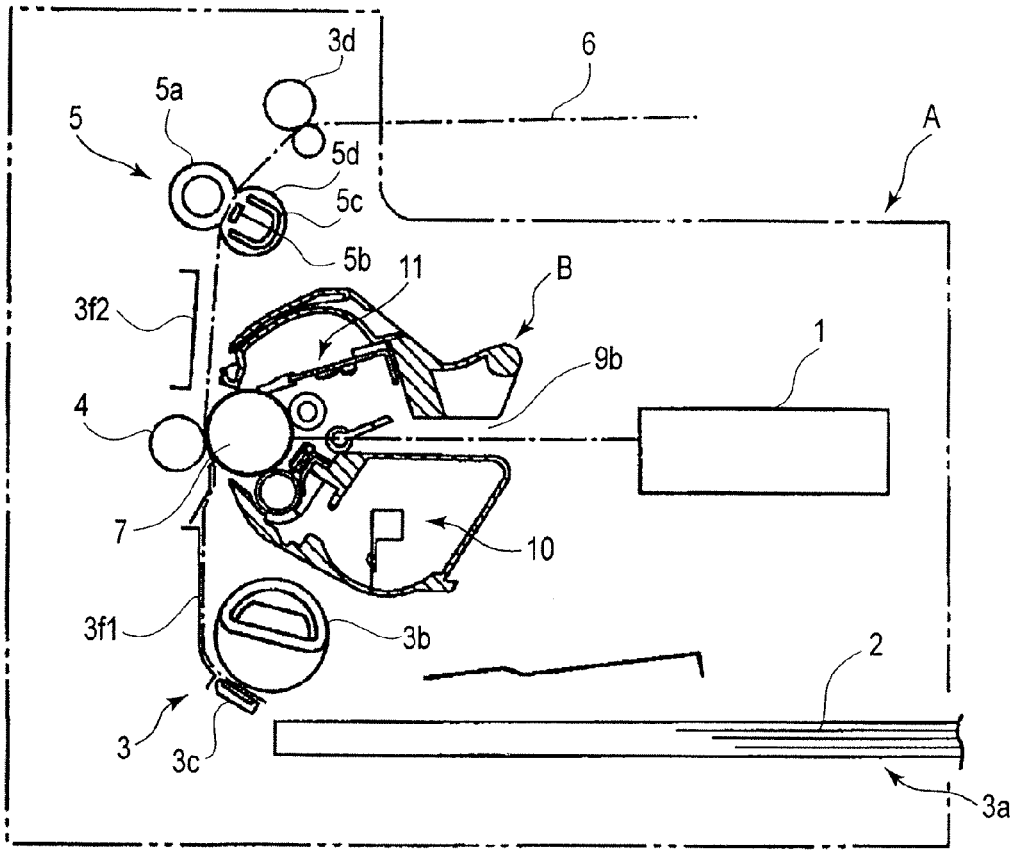
FIG. 1 is a sectional view of an electrophotographic image forming apparatus, showing the general structure thereof.
Figure 2:
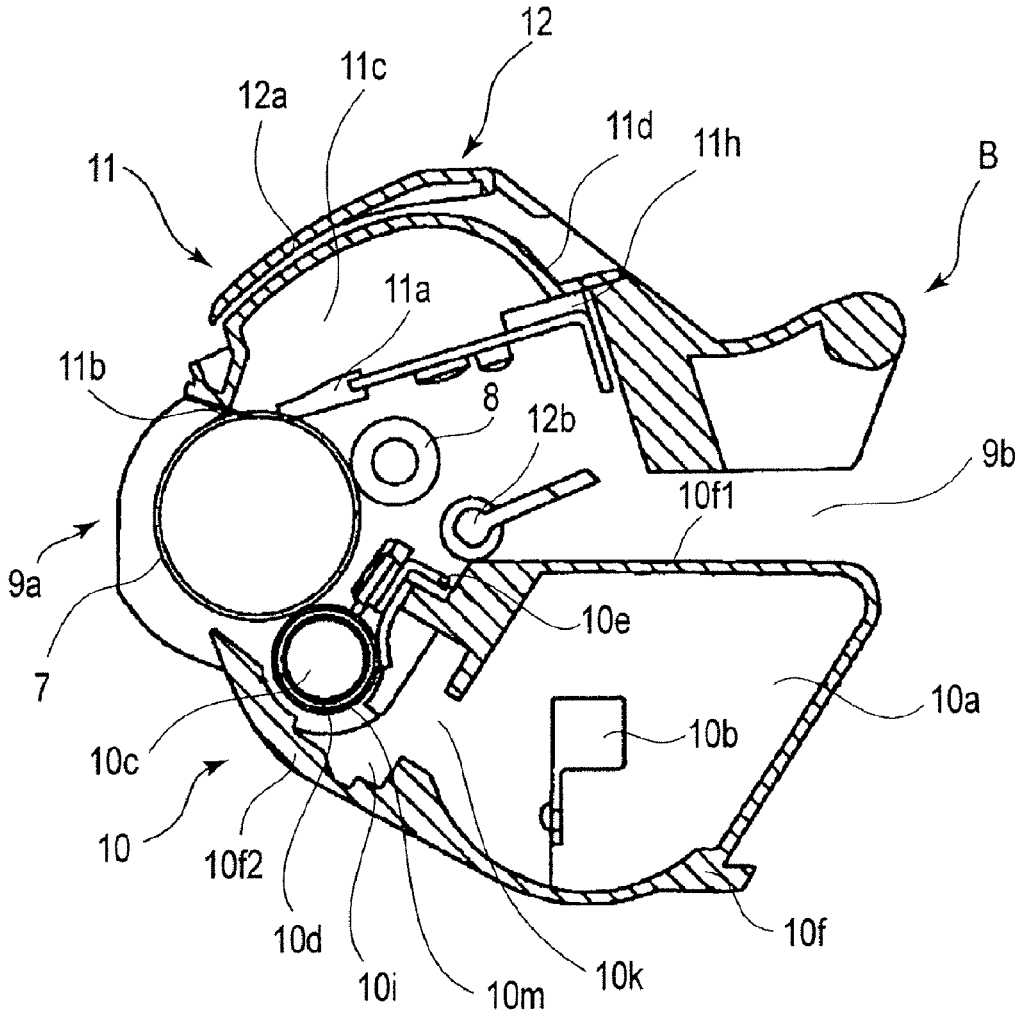
FIG. 2 is a sectional view of a process cartridge, showing the general structure thereof.

First, referring to FIGS. 1 and 2, the cartridge in this embodiment, and the electrophotographic image forming apparatus in which the cartridge in this embodiment is removably mountable, will be concretely described. FIG. 1 is a schematic drawing of the electrophotographic image forming apparatus, in which the process cartridge has been properly positioned, and depicts the general structure of the apparatus. FIG. 2 is a schematic drawing of the cartridge, showing the general structure thereof.

As for the order of description, first, the cartridge, and then, the electrophotographic image forming apparatus employing the cartridge, will be described regarding their general structures. Then, the structures for mounting the cartridge into the electrophotographic image forming apparatus, or dismounting it therefrom, will be described.

(General Structure)

Referring to FIG. 1, the electrophotographic image forming apparatus A (which hereinafter will be referred to simply as an "image forming apparatus") in the form of a laser beam printer comprises an optical system 1 as an optical means and a photosensitive drum 7 as an image bearing member. It forms a toner image (image formed of toner) through a process in which an electrophotographic latent image is formed on the peripheral surface of the photosensitive drum 7 by projecting a beam of light onto the peripheral surface of the photosensitive drum 7, while modulating it with the image formation data, and then, developing the latent image into the toner image with the use of developer (which hereinafter may be referred to as "toner").

In synchronism with the formation of the toner image, recording media 2 (recording paper, OHP sheet, fabric, etc.) are fed from a cassette 3*a* into the main assembly of the image forming apparatus, while being separated one by one by the combination of a pickup roller 3*b*, and a pressing member 3*c* kept pressed against the pickup roller 3*b*. Then, each recording medium 2 is conveyed along the conveyance guide 3*f*1, to a transfer roller 4 as a transferring means.

After the formation of the toner image on the peripheral surface of the photosensitive drum 7 in the cartridge B, the toner image on the peripheral surface of the photosensitive drum 7 is transferred onto the recording medium 7 by applying voltage to the transfer roller 4. Thereafter, the recording medium 2 is conveyed along the conveyance guide 3*f*2, to a fixing means 5.

The fixing means 5 comprises a driver roller 5*a* and a fixation roller 5*d*. The fixation roller 5*d* comprises a cylindrical sheet rotatably supported by a supporting member 5*c*, and a heater 5*b* placed within the hollow of the cylindrical sheet. As the recording medium 2 is moved through the fixing means 5, the toner image having just been transferred onto the recording medium 2 is fixed by the heat and pressure applied by the fixing means 5.

After the fixation of the toner image to the recording medium 2, the recording medium 2 is conveyed further, and discharged into a delivery tray 6, by a pair of discharge rollers 3*d*, through a reversal conveyance path.

In this embodiment, the abovementioned pickup roller 3*b*, pressing member 3*c*, discharge rollers 3*d*, etc. make up a conveying means 3.

(Process Cartridge)

The cartridge B in this embodiment is a cartridge in which an electrophotographic photosensitive member such as the photosensitive drum 7, and at least one processing means, are integrally disposed, as described previously. As for the processing means, there are a charging means for charging an electrophotographic photosensitive member, a developing means for developing an electrostatic latent image formed on the peripheral surface of the electrophotographic photosensitive member, a cleaning means for removing the toner remaining on the peripheral surface of the electrophotographic photosensitive member to clean the peripheral surface of the photosensitive member, etc.

Referring to FIGS. 1 and 2, in the cartridge B in this embodiment, the photosensitive drum 7 as an electrophotographic photosensitive member having a photosensitive layer is rotationally driven, and while the photosensitive drum 7 is rotationally driven, the peripheral surface of the photosensitive drum 7 is uniformly charged by applying voltage to the charge roller 8 as a charging means. This uniformly charged peripheral surface of the photosensitive drum 7 is exposed to a beam of light (optical image) projected from the abovementioned optical system 1, while being modulated with the image formation data, through the exposure window 9*b*. As a result, an electrostatic latent image is formed on the peripheral surface of the photosensitive drum 7. This electrostatic latent image is developed by the developing means 10.

The developing means 10 comprises a toner storage portion 10*a* and a rotatable toner conveying member 10*b*. As the toner conveying member 10*b* is rotated, the toner within the toner storage portion 10*a* is conveyed out of the toner storage portion 10*a*. The developing means 10 also comprises a development roller 10*d*, in the hollow of which a magnet 10*c* is stationarily disposed. As the development roller 10*d* is rotated, the toner is borne on the peripheral surface of the development roller 10*d*, and as the development roller is rotated, the body of toner on the peripheral surface of the development roller 10*d* is formed into a uniform layer of toner by a development blade 10*e* while being frictionally charged. Then, the toner on the development roller 10*d* is transferred onto the peripheral surface of the photosensitive drum 7 in the pattern of the electrostatic static latent image; in other words, the latent image on the peripheral surface of the photosensitive drum 7 is developed into a visible image, or an image formed of the toner.

The toner image on the photosensitive drum 7 is transferred onto the recording medium 2 by applying to the transfer roller 4 such voltage that is opposite in polarity to the toner image. After the transfer, the toner remaining on the peripheral surface of the photosensitive drum 7 is scraped down by the cleaning blade of the cleaning means 11, while being prevented from leaking from the toner storage portion 11*c* for the removed toner.

The cartridge B in this embodiment comprises a cleaning means frame 11*d* and a developing means frame 10*f*. The cleaning means frame 11*d* rotatably supports the photosensitive drum 7, and also, contains the cleaning means 11 and the charge roller 8. The developing means frame 11*d* contains the developing means 10, and has the toner storage portion 10*a*.

Next, referring to FIGS. 3-9, the developing means frame 10*f* is connected to the cleaning means frame 11*d* in such a manner that the two frames can be pivoted relative to each other about the members by which the two are connected. The development roller 10*d* is provided with a pair of spacer rings 10*m* (FIG. 7), which are fitted around the lengthwise end portions of the development roller 10*d* in order to keep a predetermined gap between the peripheral surfaces of the development rollers 10*d* and photosensitive drum 7 positioned in parallel.

Figure 7:
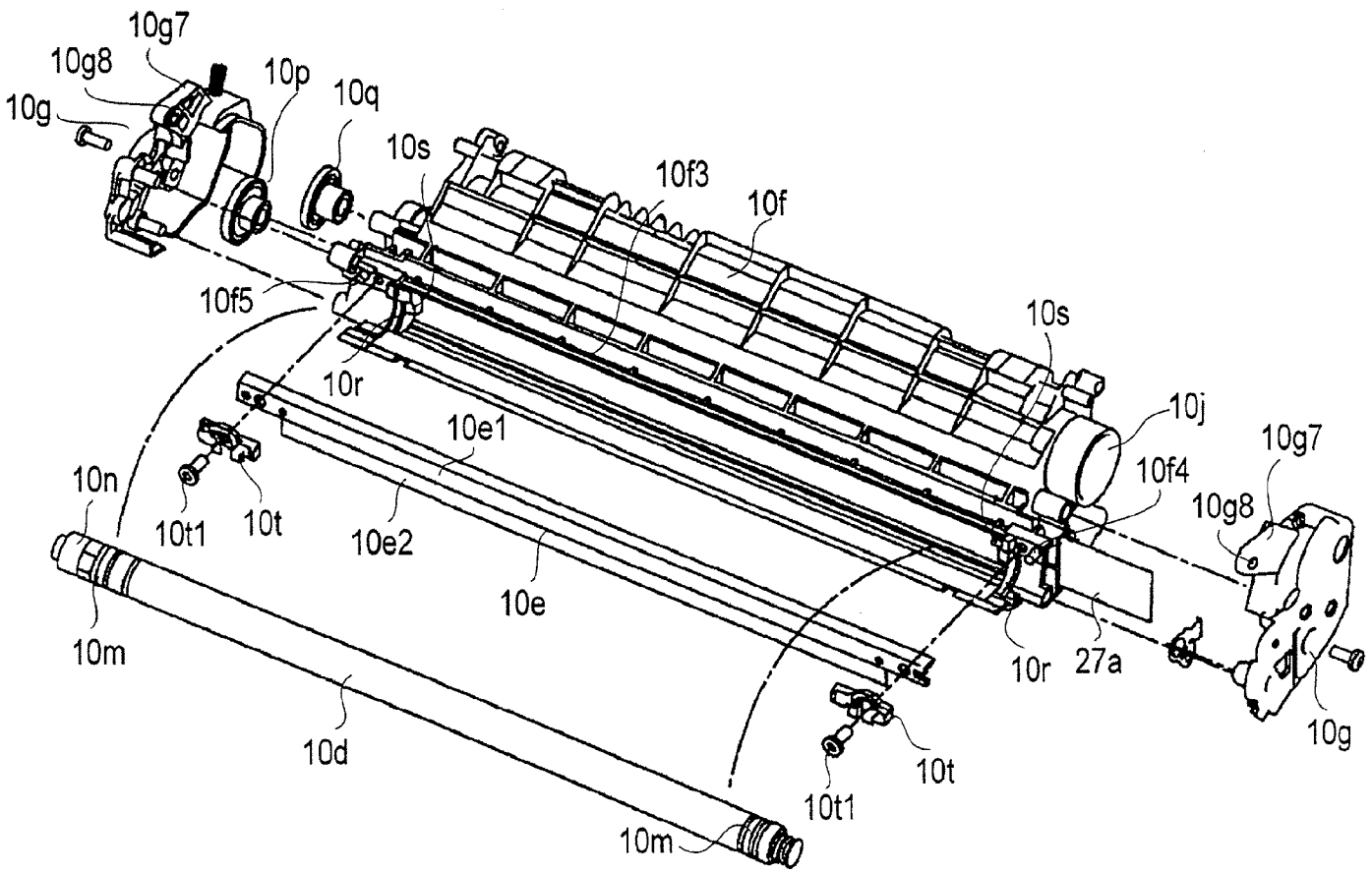
FIG. 7 is a perspective view of the disassembled process cartridge, showing the general structure of the developing means.

Referring to the abovementioned drawings, in particular, FIG. 7, the developing frame 10*f* is provided with a pair of holders 10*g*, which are attached to the lengthwise ends of the frame 10*f*, one for one. Each holder 10*g* is provided with a holder arm 10*g*7, which has a connective hole 10*g*8 for pivotally connecting the developing means 10 to the cleaning means II. Between the developing means 10 and cleaning means II, an unshown means is placed to generate a predetermined amount of pressure for maintaining the aforementioned predetermined gap, the size of which is determined by the aforementioned pair of spacers 10*m*.

Figure 6:
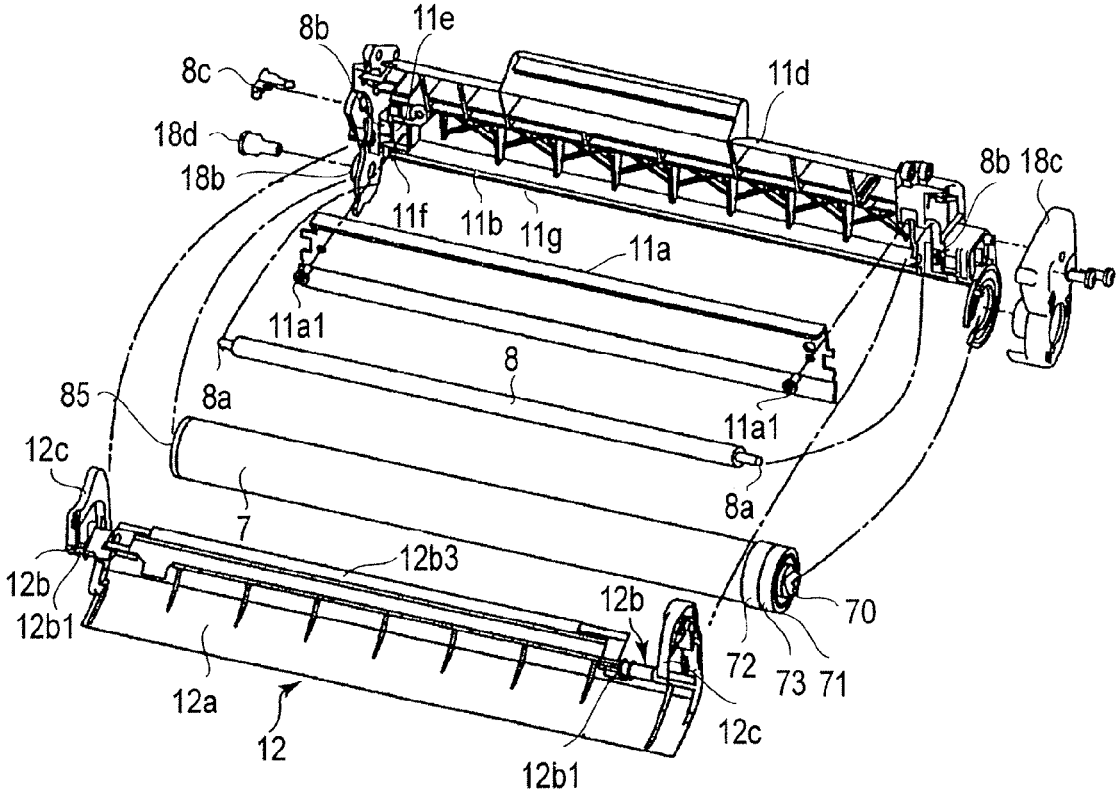
FIG. 6 is a perspective view of the disassembled process cartridge, showing the general structure thereof.

Next, referring to FIGS. 2 and 6, the cleaning means II will be described regarding its structure.

To a pair of predetermined portions of the cleaning means frame 11*d*, a pair of sealing members 11*e* and 11*h* (first and second sealing member) for preventing the toner stored in the toner storage portion 11*c* for removed toner, from leaking from the lengthwise ends of the cleaning means frame 11, at the lengthwise ends of the cleaning blade 11*a* (which hereinafter may be referred to simply as blade 11*a*), one for one, with the use of a piece of two-sided adhesive tape. To another predetermined portion of the cleaning means frame 11*d*, the blade 11*a* is firmly fixed with the use of small screws 11*a*1 or the like. As the means for not only preventing the toner from leaking at the lengthwise ends of the blade 11*a*, but also, for wiping away the toner and the like adhering to the photosensitive drum 7, a third sealing member 11*f* is firmly attached to the cleaning means frame 11*d* with the use of a piece of two-sided adhesive tape or the like. Further, a scooping sheet 11*b* is firmly attached to the cleaning means frame 11*d* with the use of a piece of two-sided adhesive tape or the like, in order to store the removed toner into the toner storage portion 11*c* for the removed toner.

In addition, to the cleaning means frame 11*d*, an electrode 8*c* for supplying the charge roller 8 with the electrical power from the main assembly of the image forming apparatus is attached.

Also attached to the cleaning means frame 11*d* are a pair of bearings 8*b*, which not only support the charge rollers 8 by the lengthwise ends of the charge rollers 8, one for one, but also, function as the path through which the electrical power is transmitted from the electrode 8*c* to the charge roller 8; the charge roller B is fitted with the pair of bearings 8*b*, which are fitted around the lengthwise ends of the charge roller 8, one for one.

One of the lengthwise ends of the photosensitive drum 7 is fitted with a drum gear 71 as a driving force receiving member. The drum gear 71 comprises: a coupling 70 to which a driving force is transmitted from the main assembly of the image forming apparatus A, and which is positioned most outward in terms of the axial direction of the photosensitive drum 7; a first gear 72, from which the received driving force is transmitted to the development roller 10*d*; and a second gear 73 from which the received driving force is transmitted to the transfer roller 4. The transfer roller 4, with which the main assembly of the image forming apparatus A is provided, is provided with a transfer gear 4*a* (FIG. 15), which meshes (engages) with the abovementioned second gear 73. Thus, as the photosensitive drum 7 is rotationally driven, the transfer roller 4 also is rotationally driven.

The photosensitive drum 7 is also fitted with a flange 85, which is located at the opposite lengthwise end from the drum gear 71. The cleaning means frame 11*d* is provided with a bearing member 18*c*, which is attached to the lengthwise end of the frame 11*d*, with the use of fastening means such as small screws or the like. At the opposite end of the photosensitive drum 7 from the bearing member 18*c*, a metallic positioning pin 18*d* is inserted through the hole of the cleaning means frame 11*d*, and is fitted in the positioning portion 18*b*. With the provision of the above described structural arrangement, the photosensitive drum 7 is rotatably supported by the cleaning means frame 11*d*. To the flange 85, a metallic grounding plate (unshown) is attached, which is in contact with the internal surface of the cylindrical portion of the photosensitive drum 7, and the positioning pin 18*d*, establishing an electrical connection between the photosensitive drum 7 and positioning pin 18*d*.

Next, the structure which supports the charge roller 8 will be described.

To the cleaning means frame 11*d*, a pair of charge roller bearings 8*b* for rotatably supporting the charge roller 8 by the metallic core portion 8*a* thereof are attached. Each charge roller bearing 8*b* is supported by the cleaning means frame 11*d*, being allowed to slide in the radius direction of the photosensitive drum 7 while being kept pressured in the radius direction of the photosensitive drum 7 by a compression spring 8*c*. With the provision of this structural arrangement, the charge roller 8 is kept in contact with the photosensitive drum 7, with the presence of a predetermined amount of contact pressure between the charge roller 8 and photosensitive drum 7, and is rotated by the rotation of the photosensitive drum 7.

Further, the cleaning means frame 11*d* of the cartridge B in this embodiment is provided with a transfer window 9*a* (FIG. 2) through which the photosensitive drum 7 is allowed to directly oppose the transfer roller 4. The cleaning means frame 11*d* is also provided with a drum shutter 12 capable of covering the transfer window 9*a*. The drum shutter 12 is rotatably supported by the cleaning means frame 11*d*.

Next, referring to FIGS. 2, 3, and 6, the structure of the drum shutter 12 will be described.

The drum shutter 12 has a drum protecting portion 12*a*, by which the drum shutter 12 covers the transfer window 9*a*. It also has a pair of axles 12*b*, which are rotatably supported by the left and right portions of the cleaning means frame 11*d*, which are near the lengthwise ends of the charge roller 8, and by which the drum shutter 12 is rotatably supported by the cleaning means frame 11*d*. Each axle 12*b* comprises a pair of sliding portions 12*b*1 which slide against the cleaning means frame 11*d*, and a portion 12*b*3 which connects the pair of sliding portions 12*b*1.

Figure 16:
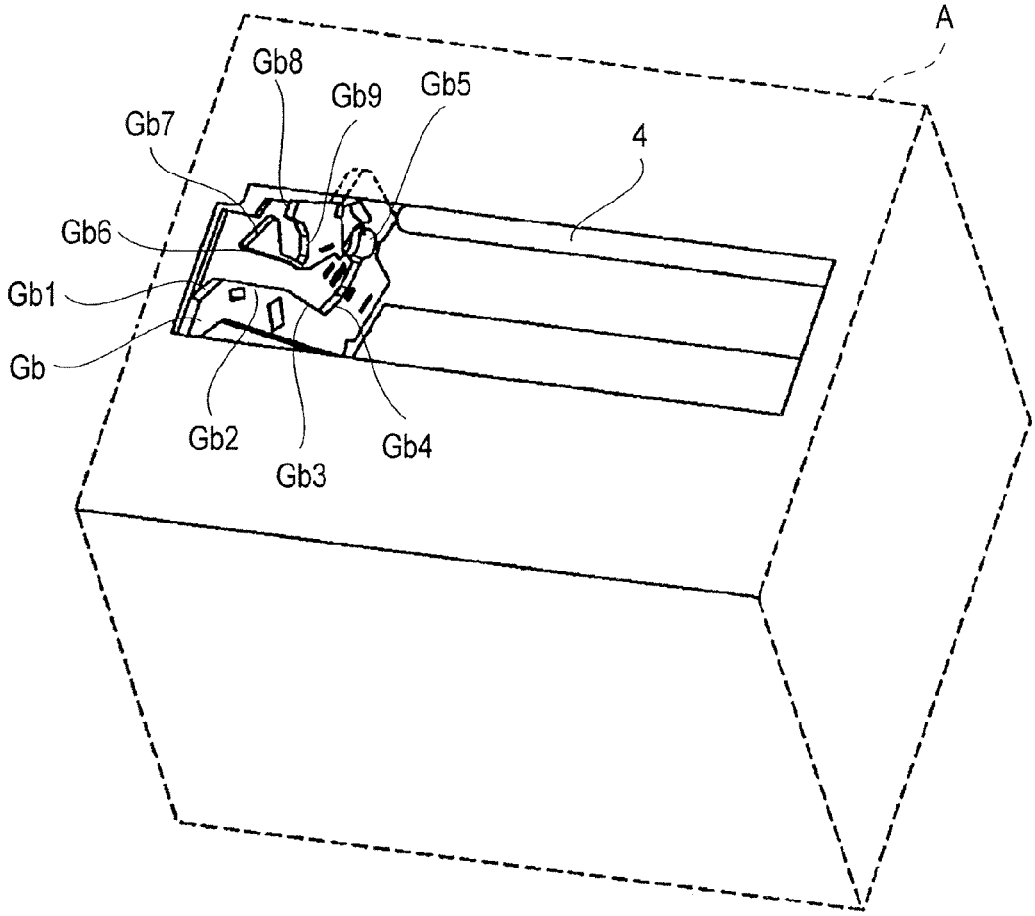
FIG. 16 is a schematic perspective view of the main assembly of the image forming apparatus, showing the guiding member thereof on the left side.
Figure 19:
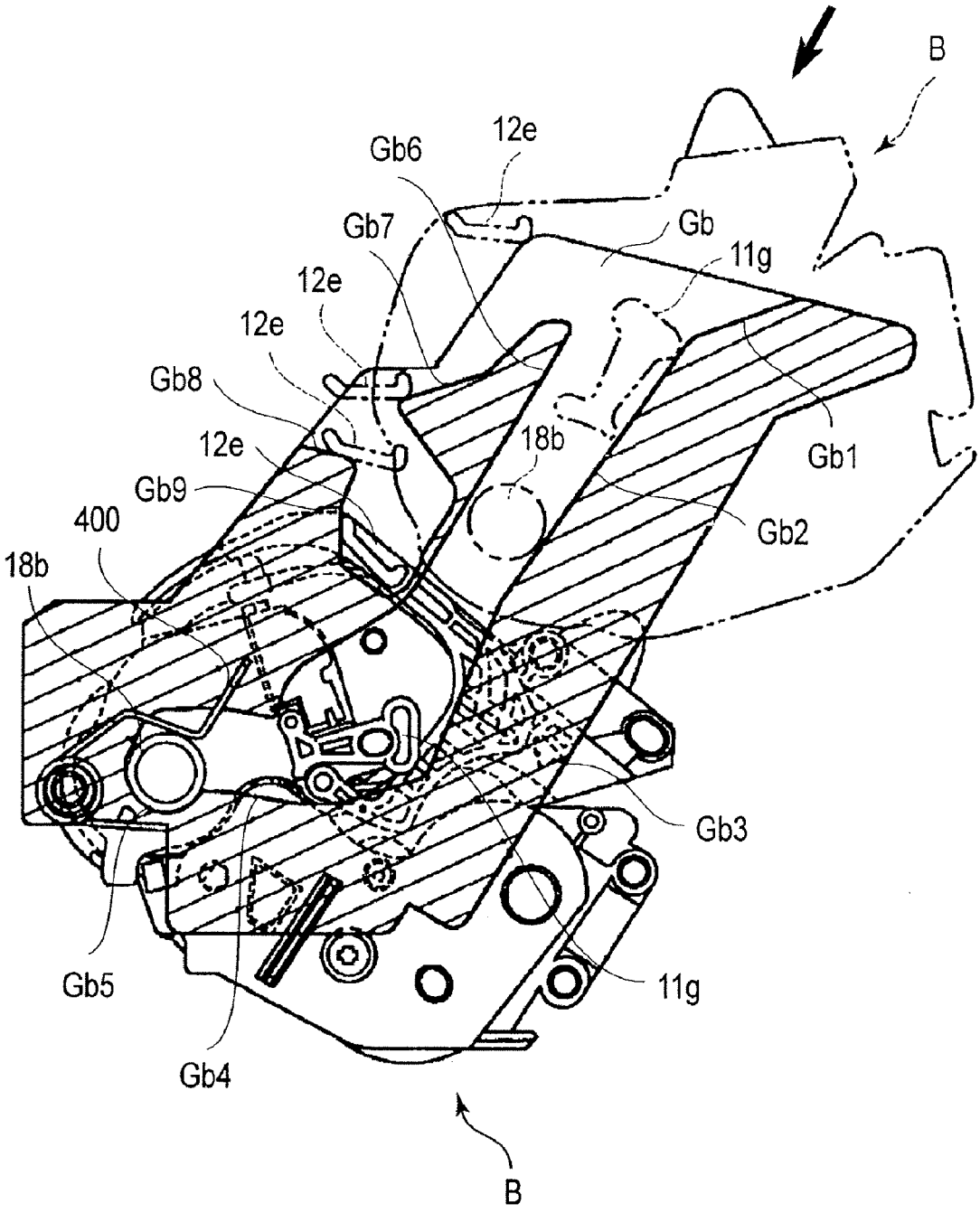
FIG. 19 is a phantom drawing for showing the positional relationship between the process cartridge and left guiding member of the main assembly, after the completion of the mounting of the process cartridge into the main assembly.

The drum shutter 12 is also provided with a pair of connective portions 12*c*, which are located at the lengthwise ends of the drum protecting portions 12*a* (at left and right ends) and connects the outward end of the axle 12*b* and the drum protecting portion 12*a*. The connective portion 12*c* on the flange side of the photosensitive drum 7 in terms of the lengthwise direction is provided with a rib 12*e* (FIG. 3), which projects outward of the cartridge B in terms of the lengthwise direction. As the cartridge B is mounted into the main assembly of the image forming apparatus A, the rib 12*c* comes into contact with the shutter guide Gb9 of the guide Gb of the main assembly of the image forming apparatus A, opening the drum shutter 12, and then, keeping the drum shutter 12 open, as shown in FIGS. 16 and 19. The drum shutter 12 is under the pressure generated by the shutter springs (unshown) in the direction to cover the photosensitive drum 7.

Figure 3:
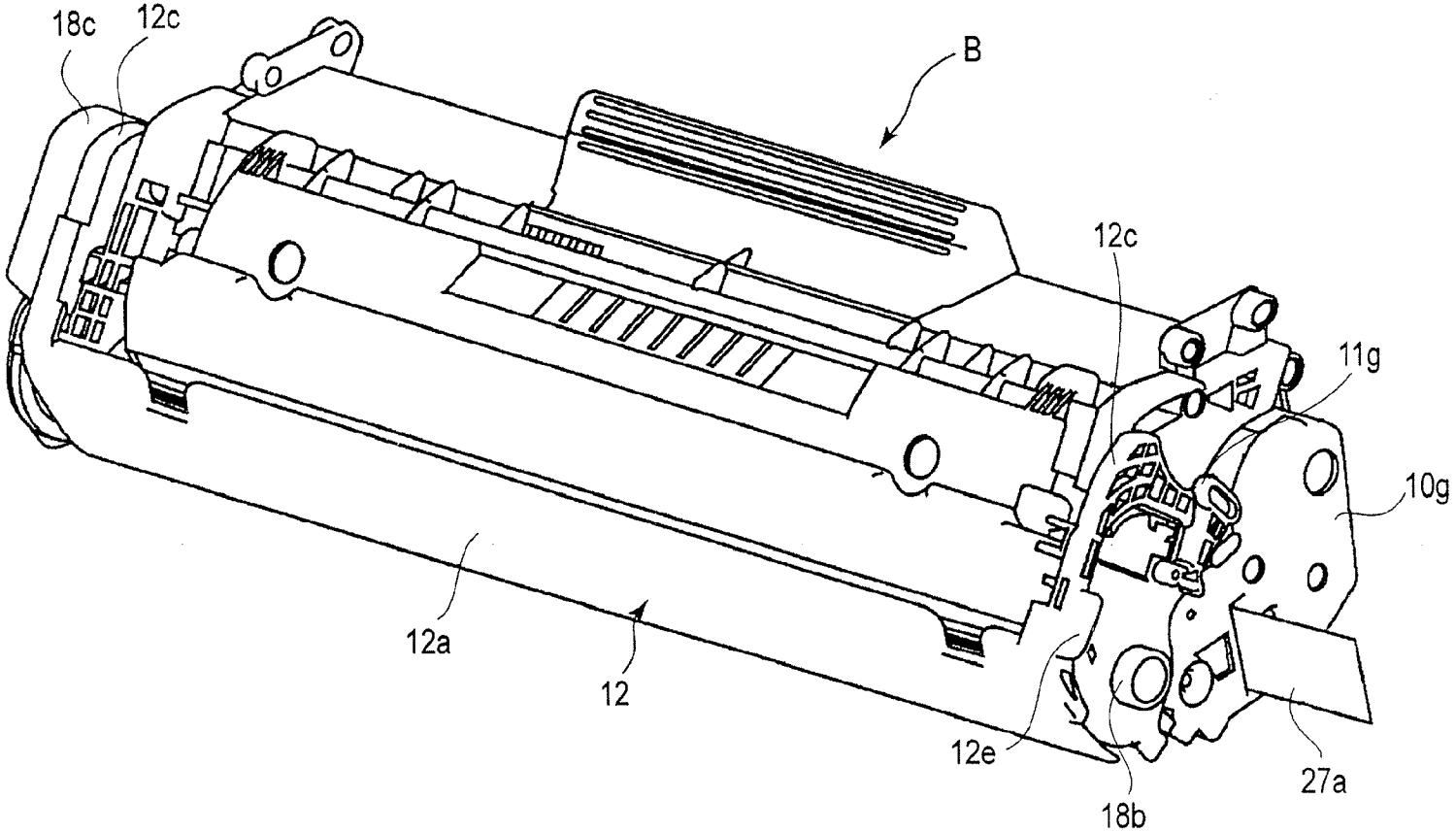
FIG. 3 is a perspective view of the process cartridge, showing the general structure thereof.
Figure 4:
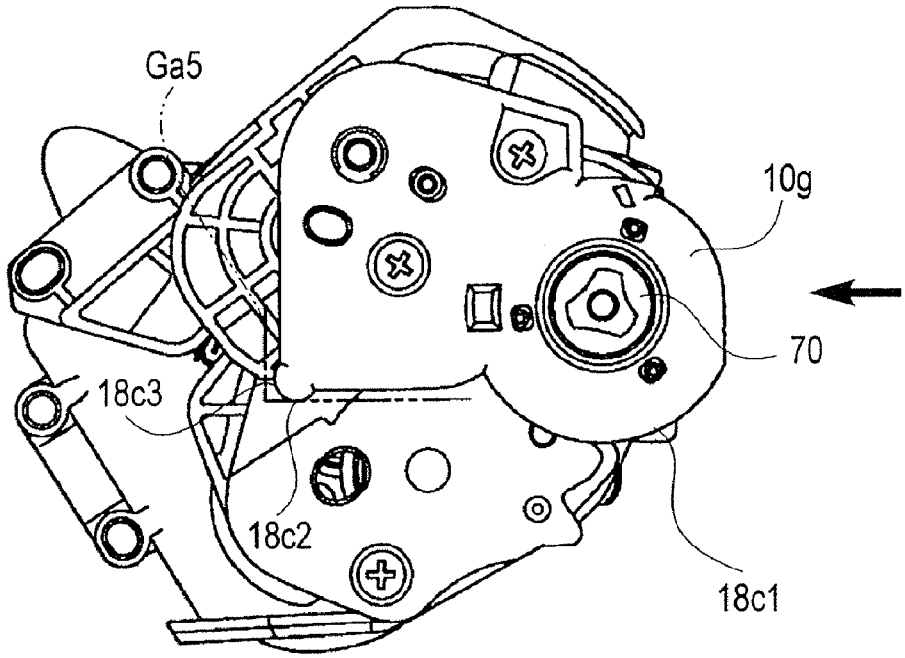
FIG. 4 is a side view of the process cartridge, as seen from the right side.

With the provision of the above described structural arrangement, while the cartridge B is outside the main assembly of the image forming apparatus A, the drum shutter 12 remains in the protective position, covering the transfer window 9*a* to protect the photosensitive drum 7, as shown in FIG. 3. However, as the cartridge B is mounted into the main assembly of the image forming apparatus A, the drum shutter 12 is rotated by the drum shutter opening means of the main assembly of the image forming apparatus A, exposing the transfer window 9*a* as shown in FIG. 1 or 2. Thus, after the mounting of the cartridge B into the main assembly of the image forming apparatus A, that is, when the image forming apparatus A is ready for image formation, the drum shutter 12 remains in the exposing position, in which it allows the photosensitive drum 7 and transfer roller 4 to contact each other. In other words, the drum shutter 12 is enabled to take the protective position in which it protects the photosensitive drum 7, and an evasive or exposing position (exposing portion) in which it does not interfere with the image formation process.

Next, the developing means 10 of the cartridge B will be described in detail.

Figure 8:
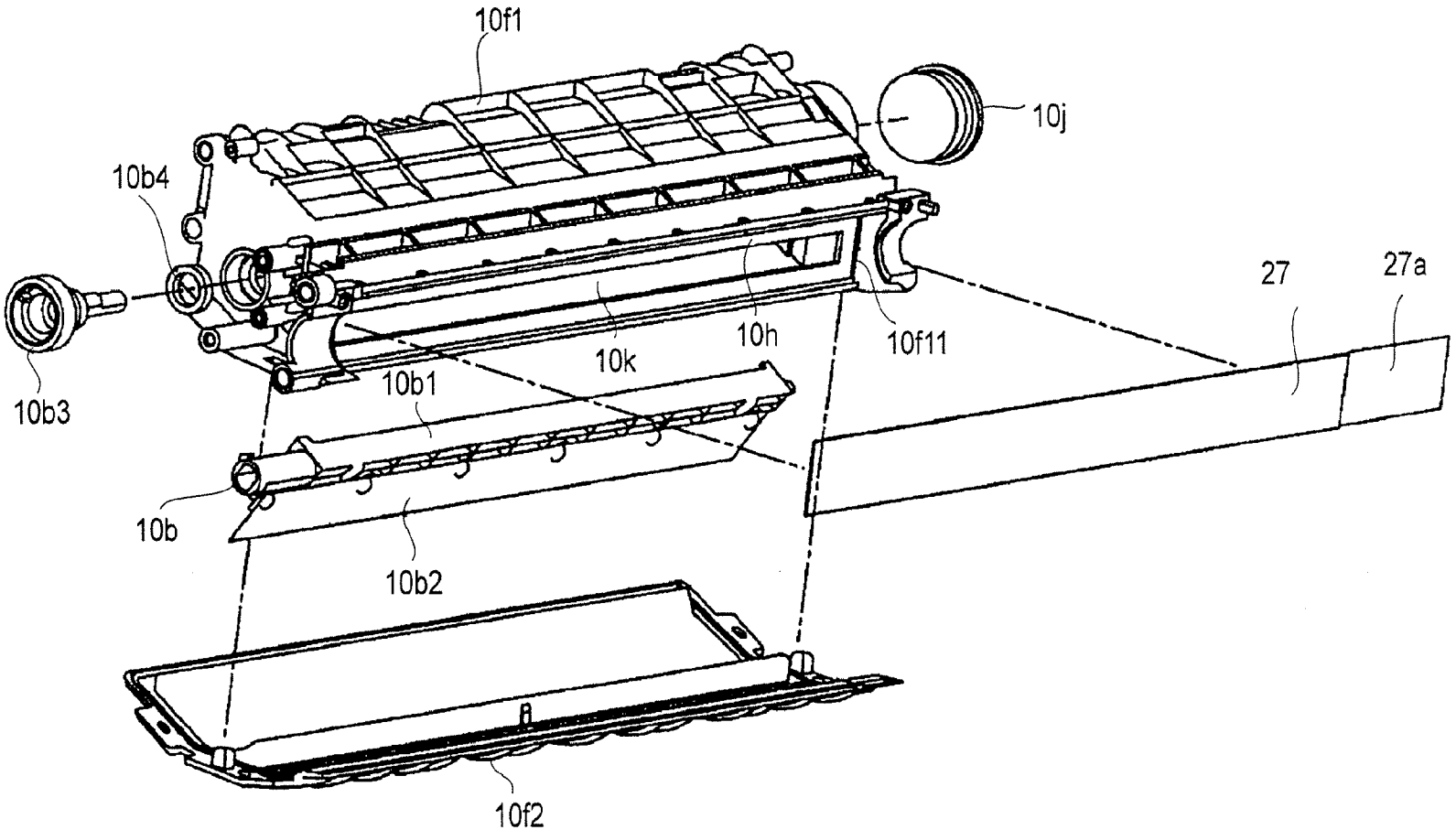
FIG. 8 is a perspective view of the disassembled process cartridge, showing the general structure of the developing means.

Referring to FIGS. 2 and 8, the developing means 10 comprises a toner chamber 10*a* (toner storage portion) and development chamber 10*i*, which are formed by connecting the main portion 10*f*1 of the developing means frame 11*d* and the lid portion 10*f*2 of developing means frame 11*d*.

The main portion 10*f*1 of the developing means frame 10*f* contains a stirring member 10*b* for supplying the development roller 10 with toner. The stirring member 10*b* comprises a shaft 10*b*1, and a sheet 10*b*2 fastened to the shaft 10*b*1. To the shaft 10*b*1, a gear 10*b*3 for transmitting a driving force to the shaft 10*b*1 and regulating the position of the stirring shaft in terms of the lengthwise direction, and a sealing member 10*b*4 for preventing toner from leaking out of the developing means frame 10*f*, are attached.

The main portion of the developing means frame 10*f* is provided with a toner conveyance opening 10*k* through which the toner in the toner chamber 10*a* is conveyed to be supplied to the development roller 10*d*. Referring to FIG. 8, the above-mentioned sealing member 27 is welded to the sealing member mount 10*h*, which surrounds all four edges of the abovementioned toner conveyance opening 10*k*.

One of the lengthwise ends of the developing means frame 10*f* is provided with an opening (unshown) through which the toner chamber 10*a* is filled with toner, and which is sealed with a cap 10*j* after the filling of the toner chamber 10*a* with toner.

Referring to FIG. 7, the developing means frame 10*f* is also provided with a pair of seals 10*r*, which are attached to the lengthwise ends of the developing means frame 10*f*, one for one, to prevent toner from leaking from the developing means frame 10*f*, at the lengthwise ends of the development roller 10*d*. To the lengthwise ends of the main portion 10*f*1 of the developing means frame 10*f*, a pair of seal 10*s* are attached, with the use of a piece of two-sided adhesive tape or the like, in order to prevent toner from leaking from the developing means frame 10*f* at the lengthwise ends of the development blade 10*c*.

Along with a scraping member 10*t* for scraping away the toner on the lengthwise end portions of the peripheral surface of the development roller 10*d*, the development blade 10*e* is firmly attached to the developing means frame 10*f*, with the use of a pair of small screws 10*t*1. Regarding the attachment of the development blade 10*e* to the developing means frame 10*f*, the developing means frame 10*f* is structured, in terms of measurements, so that as the pair of small screws 10*t*1 are tightened to fasten the development blade 10*e* to the developing means frame 10*f*, the edge portion of the developing means frame 10*f*, which is gradually reduced in thickness toward the edge, bites into the rubber portion 10*e*2 of the development blade 10*e*. Thus, after the attachment of the development blade 10*e* to the developing means frame 10*f*, there is absolutely no gap between the rubber portion 10*e*2 of the development blade 10*e* and the developing means frame 10*f*.

(Structure of End Member)

Referring to FIGS. 7 and 8, the developing means frame 10*f* is provided with a pair of end members 10*g*, which are located at the lengthwise ends of the developing means 10. One of the end members 10*g* covers a gear train comprising a development roller gear 10*n* (FIG. 7), and two idler gears 10*p* and 10*q*. The development roller gear 10*n* is fixed to one of the lengthwise ends of the development roller 10*d*, and is in mesh with the drum gear (unshown) fixed to the lengthwise end of the photosensitive drum 7. The pair of idler gears 10*p* and 10*q* are for transmitting the driving force from the development roller gear 10*n* to the aforementioned gear 10*b*3 of the stirring member 10*b*.

The pull-tab portion 27*a* of the sealing member 27 is folded back, at one end of the toner conveyance opening

10*k*, in terms of the lengthwise direction of the opening 10*k*, and is extended back to the opposite end of the opening 10*k*, and is extended outward of the end member 10*g* through the hole 10*f*11 of the main portion 10*f*1 of the developing means frame 10*f*.

Figure 9:
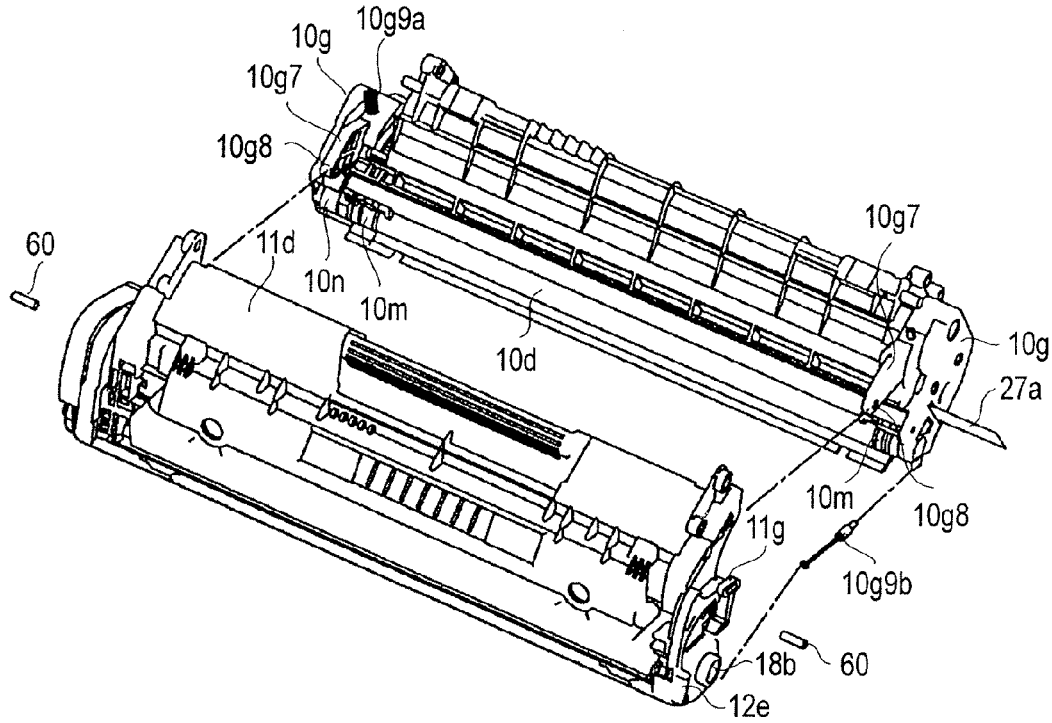
FIG. 9 is a perspective view of the partially disassembled process cartridge, showing the connective structure between the cleaning means and developing means.
Figure 10:
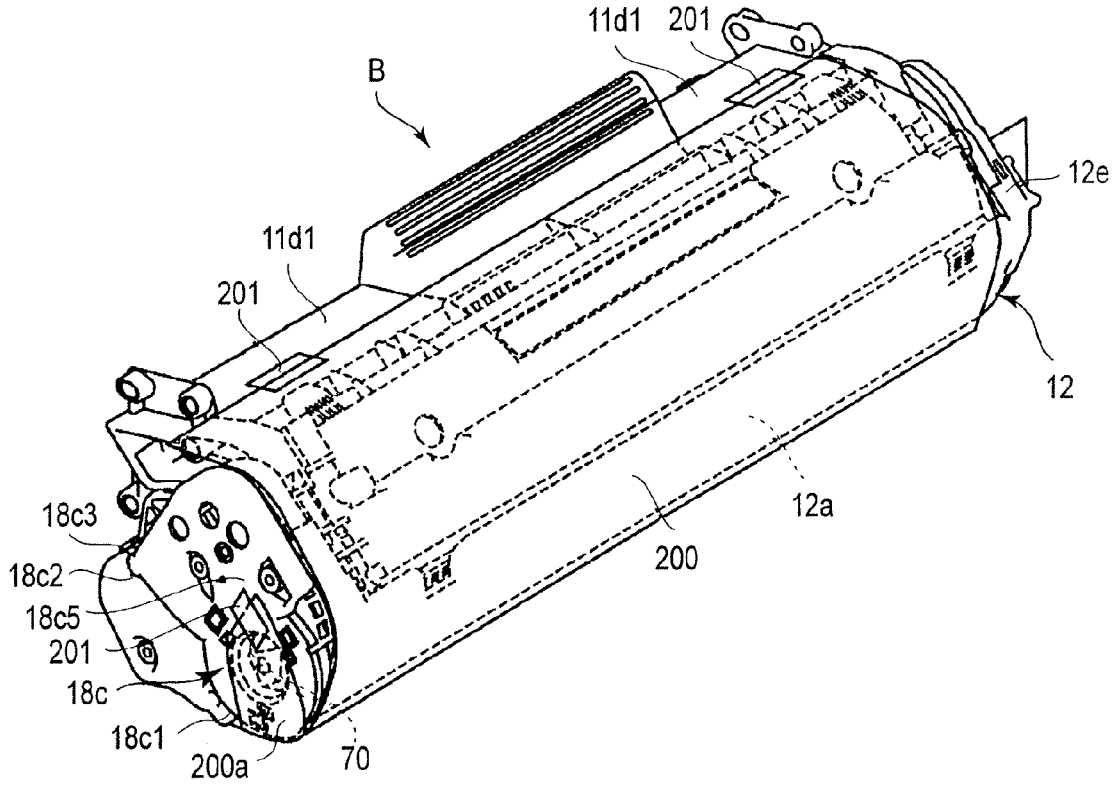
FIG. 10 is a perspective view of the process cartridge fitted with a protective member.

Referring to FIG. 9, the developing means 10 and cleaning means 11, which are structured as described above, are connected as will be described next.

That is, the two end members 10*g* are provided with an arm 10*g*7, which extends toward the cleaning means frame 11*d*. Each arm 10*g*7 is provided with a connective hole 10*g*8, which is located at the end of the arm 10*g*7. Thus, the cleaning means frame 10*d* and end member 10*g* can be connected to each other by inserting a pin 60 through the connective hole 10*g*8 of each arm 10*g*7 and the corresponding connective hole (unshown) of the cleaning means frame 10*d*, so that the cleaning means frame 11*d* and the end member 10*g* can be rotated relative to each other about the pin 60. At one of the lengthwise ends of the cartridge B, a compression coil spring 10*g*9*a* is positioned between the end member 10*g* and cleaning means frame 11*d*, with the one end of the compression coil spring 10*g*9*a* fitted in the spring seat of the end member 10*g*, whereas at the other lengthwise end of the cartridge B, a tension spring 10*g*9*b* is positioned between the cleaning means frame 11*d* and end member 10*g*, with the lengthwise ends of the tension spring hooked to the cleaning means frame 11*d* and end member 10*g*, one for one. Thus, the gap retaining members, or spacers 10*m*, fitted around the lengthwise end portions of the development roller 10*d*, one for one, are kept in contact with the peripheral surface of the photosensitive drum 7, and therefore, the predetermined amount of gap is maintained between the development roller 10*d* and photosensitive drum 7. This concludes the process of assembling the process cartridge B.

When a user who purchased the cartridge B uses the cartridge B for the first time, the user is to pull out the sealing member 27*a* shown in FIG. 3. As the sealing member 27*a* is pulled out, the toner conveyance opening 10*k* of the main portion 10*f*1 of the developing means frame 10*f* is unsealed, allowing the toner in the toner chamber 10*a* to be conveyed into the development chamber 10*i*; in other words, the cartridge B is readied to be inserted into the main assembly of the image forming apparatus A.

(Protective Member)

In the case of the cartridge B, which is in the main assembly of the image forming apparatus A when a user purchases the image forming apparatus A, its coupling 70 as a driving force receiving member attached to the drum gear 71 is ready to be engaged with the driving force transmitting member 300 (FIG. 15) of the main assembly of the image forming apparatus A when the cartridge B is mounted into the main assembly for the first time for actual usage instead of shipment.

Referring to FIGS. 10-14, the cartridge B which comes in the main assembly of the image forming apparatus A when a user purchases the image forming apparatus A is fitted with a protective member 200, which is removably attached to the cartridge B in such a manner that the cartridge B is partially wrapped by the protective member 200.

The protective member 200 is formed of a flexible sheet. In terms of the lengthwise direction of the photosensitive drum 7, the protective member 200 is wide enough to cover the entirety of the photosensitive drum 7 or the range in which the transfer roller is contacted to the photosensitive member 7. The method for attaching the protective member 200 to the cartridge B is as follows. In terms of the widthwise direction, or the circumferential direction of the cartridge 7 perpendicular to the lengthwise direction, the protective member 200 is attached to the portion 11*d*1 (shown in FIG. 10) of the top surface of the cleaning means frame 11*d*, which does not interfere with the drum shutter 12 in the opened position, with the use of a fastening means 201, such as a piece of adhesive tape.

Figure 11:
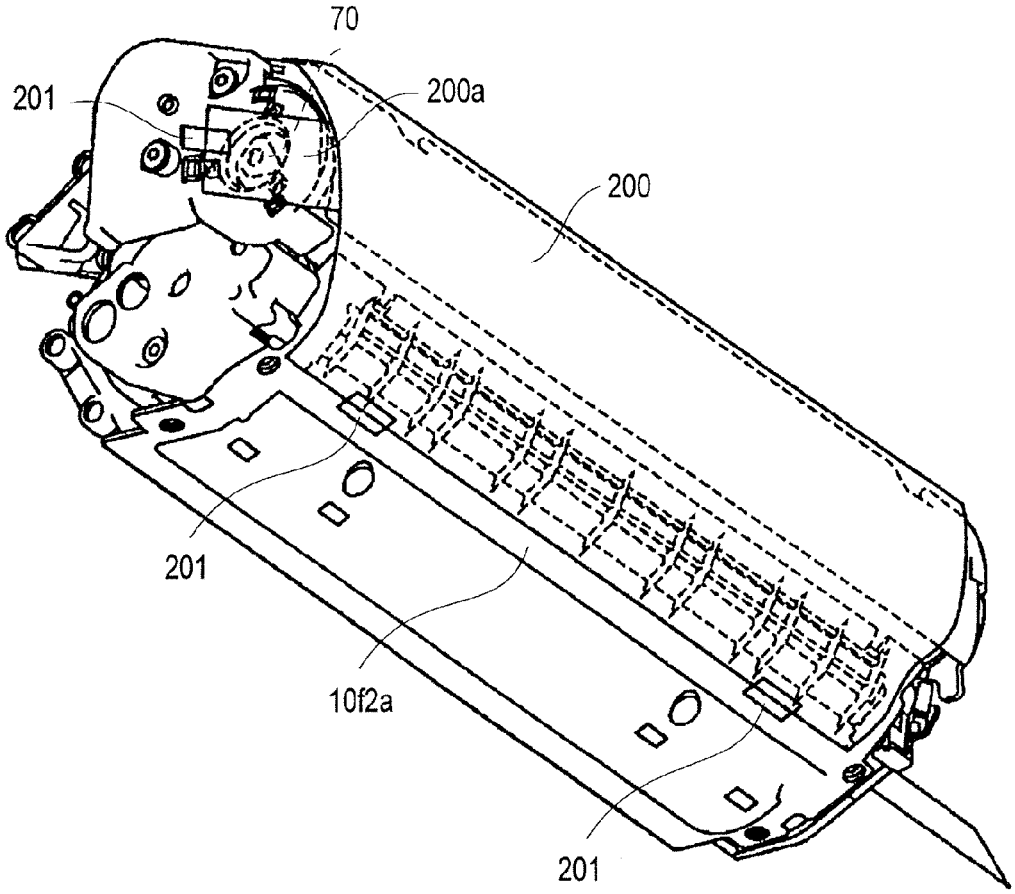
FIG. 11 is a perspective view of the process cartridge fitted with a protective member.
Figure 12:
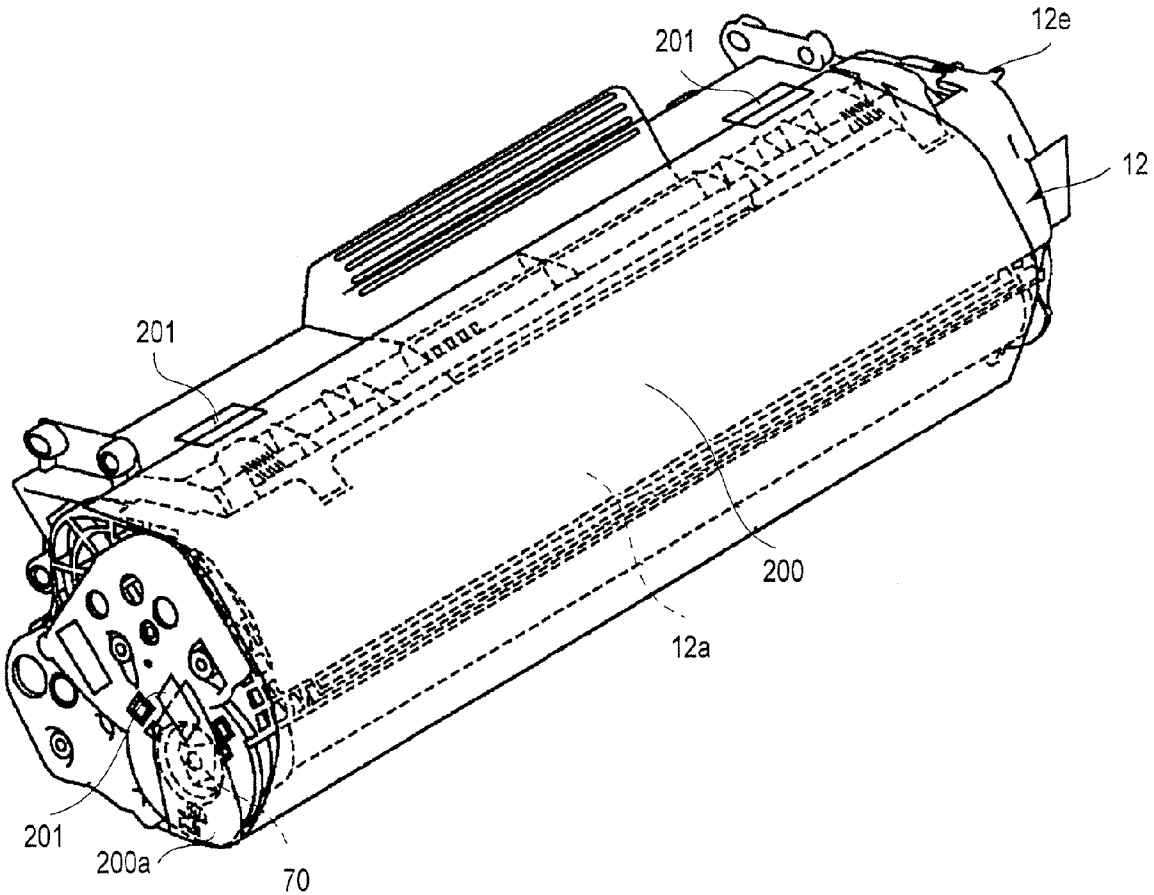
FIG. 12 is a perspective view of the process cartridge, which is fitted with a protective member, and the drum shutter of which is open.

When the protective member 200 is protecting the cartridge B, it covers the top surface of the cleaning means frame 11*d*, the top surface of the drum shutter 12 covering the transfer opening 9*a*, and the bottom surface of the developing means 10. As for the other edge of the protective member 200 in terms of the widthwise direction, it is fixed to the flat portion 10*f*2*a* of the lid portion 10*f*2 of the developing means frame 10*f*, with the use of fastening means 201 such as a piece of adhesive tape, as shown in FIG. 11.

A portion 200*a* of the protective member 200 is extended toward the bearing member 18*c*, covering the coupling 70, and is fastened to a portion 18*c*5 of the bearing member 18*c*, with the use of the fastening means 201 such as a piece of adhesive tape. In terms of the direction in which the cartridge B is mounted into the main assembly of the image forming apparatus A, the portion 18*c*5 of the bearing member 18*c* is on the upstream side of the coupling 70.

As the cartridge B covered with the protective member 200 is mounted into the main assembly of the image forming apparatus A, the protective member 200 is positioned between the photosensitive drum 7 and transfer roller 4, between the second gear 73 and transfer roller gear 4*a*, and between the coupling 70 and the driving force transmitting member 300, protecting therefore the photosensitive drum 7, the second gear 73, the transfer roller gear 4*a*, the coupling 70, and the driving force transmitting member 300, which might become damaged by being rubbed against the corresponding components if the protective member 200 were not present.

Therefore, even when the image forming apparatus A in which the brand-new cartridge B is present in the image forming position is packaged and shipped, the problems that the peripheral surface of the photosensitive drum 7 is implanted with frictional memories attributable to the friction between the peripheral surfaces of the photosensitive drum 7 and transfer roller 4 caused by the vibrations and impacts which occur during shipment, the problem that the second gear 73 and transfer gear 4*a* suffer from such damage as scratches and dents, across the portions in the contact area between the second gear 73 and transfer gear 4*a*, and the problem that the portion of the coupling 70 and the portion of the transfer gear 4*a*, which remain in contact with each other during shipment, suffer from such damage as scratches, dents, and the like, do not occur.

In other words, with the provision of the structural arrangement in this embodiment described above, even when the image forming apparatus A is transported, with the cartridge B positioned in the image forming position by the positioning means, the portions of the image forming apparatus, through which the driving force is transmitted, and the photosensitive drum 7 on which an image is formed, are protected from the vibrations and impacts which occur during transportation. Therefore, it is unnecessary to increase the image forming apparatus A in size in order to make it possible to ship, without damage, the image forming apparatus A with the cartridge B placed in the image forming position. Therefore, it is possible to reduce the materials for a carton or wrapping in which the image forming apparatus A is to be placed for shipment, and also, it is possible to reduce the space necessary for the shipment.

Further, when the image forming apparatus A, in which the cartridge B has been held in the image forming position by the cartridge positioning means, is shipped, the portion of the coupling 70 (for transmitting the rotational driving force to the photosensitive drum 7) facing the gear 73 (for transmitting the driving force to the transferring means, photosensitive drum 7), the portion of the gear 73 facing the coupling 70, the portion of the photosensitive drum 7 facing the transfer roller 4, and the portion of the transfer roller 4 facing the photosensitive drum 7, are protected from the vibrations and impacts which occur during shipment. Therefore, it is unnecessary to increase the image forming apparatus A in size in order to protect the aforementioned portions when shipping the image forming apparatus A with the cartridge B placed in the image forming position. Therefore, it is possible to reduce the amount of the packaging or wrapping materials for shipping the image forming apparatus A with the cartridge B placed in the image forming position. In other words, according to this embodiment of the present invention, the image forming apparatus A and the cartridge B therefor can be safely shipped together in the same box, with the cartridge B placed in the image forming position in the main assembly of the image forming apparatus A, eliminating the need for the space dedicated for the cartridge B. Therefore, it is possible to substantially reduce in size the carton in which the main assembly of the image forming apparatus A and the cartridge therefor are placed together for shipment.

Figure 13:
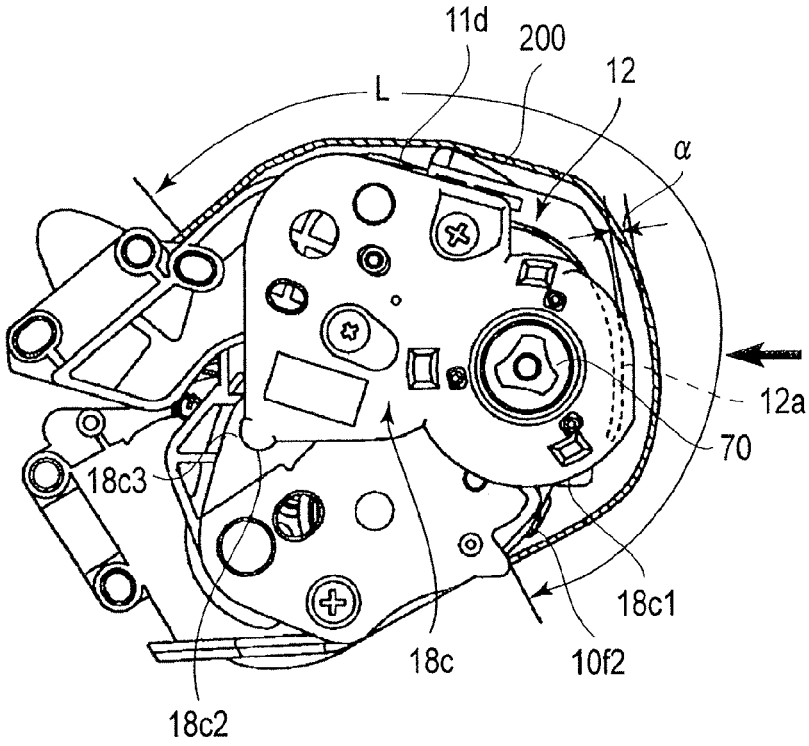
FIG. 13 is a side view of the process cartridge, as seen from the right side, which is fitted with the protective member.

Referring to FIG. 13, the protective member 200 is attached to the cartridge B so that a gap α is provided between the cleaning means frame 11*d* and protective member 200, between the drum shutter 12 and protective member 200, and between the lid portion 10*f*2 and protective member 200. This gap α is provided for preventing the protective member 200 from interfering with the opening or closing movement of the drum shutter 12 (movement between protective position and evasive position). If the gap α is insufficient, that is, if the protective member 200 is attached to the cartridge B so that it virtually follows the contour of the cartridge B, the protective member 200 interferes with the opening or closing movement of the drum shutter 12, in particular, as the drum shutter 12 is moved in the opening direction by the insertion of the cartridge B into the main assembly of the image forming apparatus A, the drum shutter 12 hangs up with the protective member 200.

Figure 14:
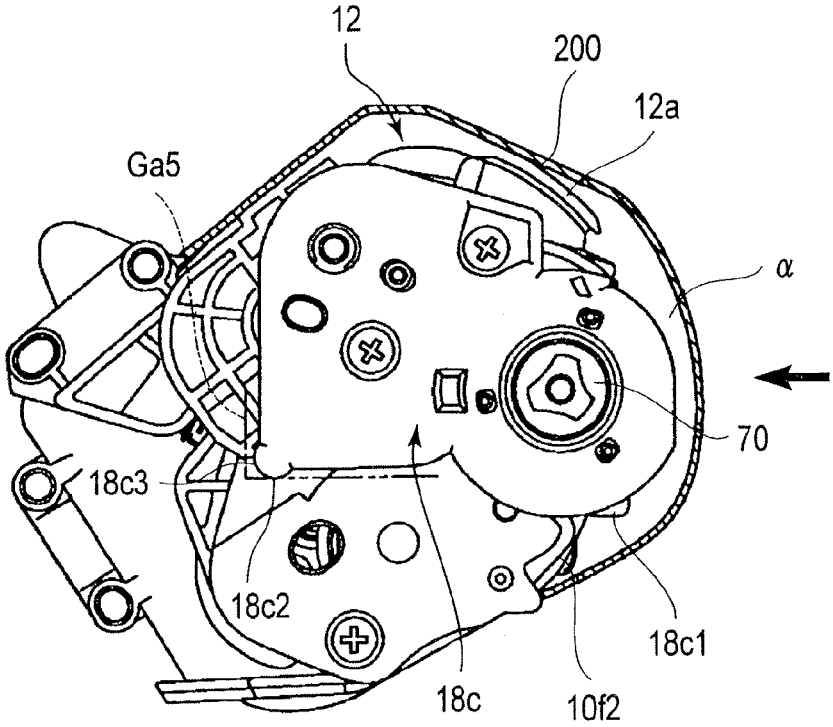
FIG. 14 is a side view of the process cartridge, as seen from the left side, which is fitted with the protective member, and the drum shutter of which is open.

Referring to FIGS. 13 and 14, in this embodiment, by making the widthwise dimension L of the protective member 200 roughly 145 mm, the gap (α) of 5-10 mm, in term of the radius direction of the photosensitive drum 7, can be provided to prevent the protective member 200 from interfering with the opening or closing movement of the drum shutter 12.

As for the dimension of the protective member 200 in terms of the lengthwise direction, it should be long enough to cover the entire lengthwise range of the cartridge B, but, be short enough to leave the rib 12*b* exposed. Giving the protective member 200 such a size prevents the protective member 12 from being pinched between the rib 12*c* and shutter guide Gb9 (FIG. 16), preventing thereby the problem that when the drum shutter 12, the movement of which is caused by the mounting or dismounting movement of the process cartridge B, is opened or closed by the movement of the process cartridge, the protective member 200 is pinched between the rib 12*c* and shutter guide Gb9 and interferes with the opening or closing of the drum shutter 12.

As the material for the protective member 200, resin sheet, the thickness of which is in the range of 10-500 μm, preferably, 50-200 μm, is usable with good results. In this embodiment, sheet formed of the mixture of high density polyethylene (10%) and low density polyethylene (90%) was used, and its thickness was 100 μm.

(Mounting of Process Cartridge B into Image Forming Apparatus Main Assembly and Removal of Process Cartridge)

The process cartridge B is mounted into the main assembly of the image forming apparatus A either for shipment or image formation. As for how the process cartridge B is mounted into the main assembly, this will be described with reference to FIGS. 10-14, and FIGS. 15-17.

The bearing member 18*c* attached to the cleaning means frame 11*d* of the cartridge B is provided with a guiding portion 18*c*1 (first contact portion) for guiding the process cartridge B when the process cartridge B is mounted into the main assembly of the image forming apparatus A. The guiding portion 18*c*1 is in the form of an arc, the center of which coincides with the axial line of the photosensitive drum 7. The bearing member 18*c* is also provided with a rotation controlling portion 18*c*2 (second contact portion), which also is in the form of an arc. The rotation controlling portion 18*c*2 is located at the corner of the bottom edge of the bearing member 18*c*, and the front edge of the bearing member 18*c* in terms of the cartridge insertion direction. The rotation controlling portion 18*c*2 (second contact portion) controls the attitude of the cartridge B in terms of the rotation of the cartridge B about its rotational axis which coincides with the rotational axis of the photosensitive drum 7.

In terms of the direction parallel to the axial line of the photosensitive drum 7, the guiding portion 18*c*1 in the form of an arc, and the rotation controlling portion 18*c*2, are located outward of the developing means 10. As the two portions 18*c*1 and 18*c*2 are seen from the direction parallel to the axial line of the photosensitive drum 7, the guiding portion 18*c*1 at least partially overlaps with the developing means 10, whereas the portion 18*c*2 entirely overlaps with the developing means 10. Further, in terms of the direction in which the cartridge 7 is inserted into the main assembly of the image forming apparatus A, the rotation controlling portion 18*c*2 is behind the guiding portion 18*c*1.

In this embodiment, the coupling 70 as the driving force receiving member which receives the driving force from the main assembly of the image forming apparatus A is inward of the bearing member 18*c* in terms of the lengthwise direction of the cartridge B.

Figure 15:
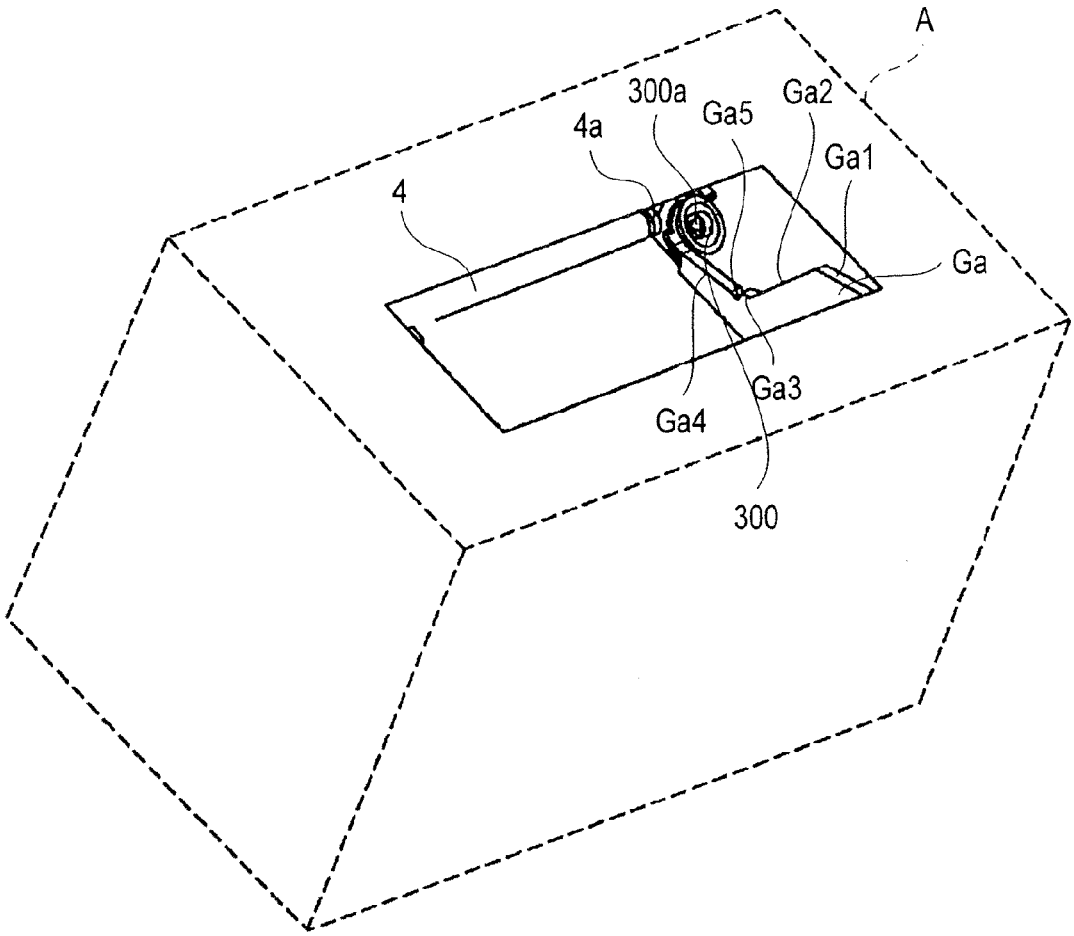
FIG. 15 is a schematic perspective view of the main assembly of an image forming apparatus, showing the guiding member thereof on the right side.

Referring to FIG. 15, the main assembly of the image forming apparatus A is provided with a guiding member Ga, which guides the cartridge B into the image forming position by allowing the cartridge B to slide on the guiding member Ga by the guiding portion 18*c*1 and rotation controlling portion 18*c*1.

Figure 5:
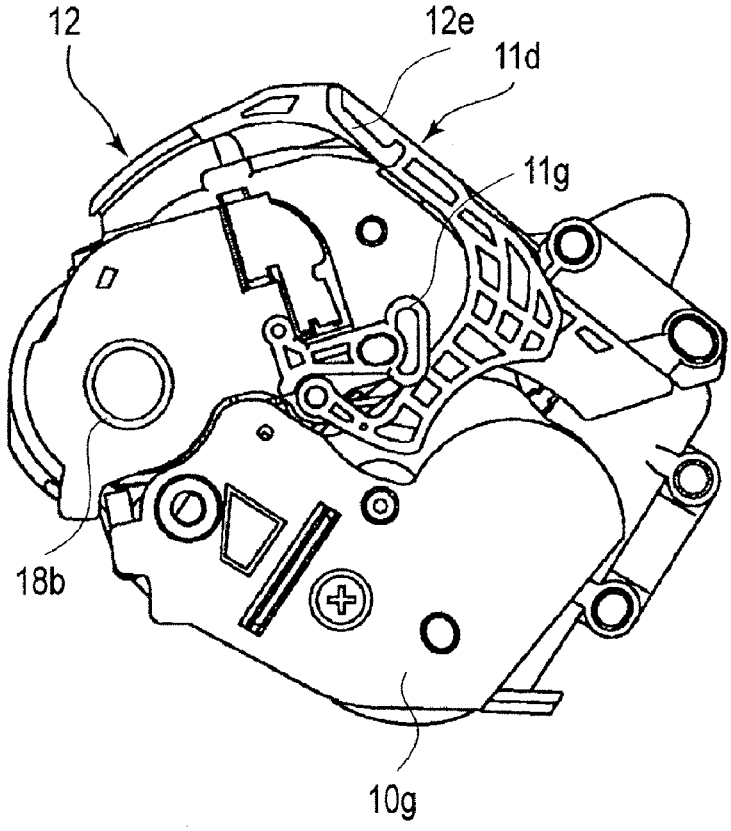
FIG. 5 is a side view of the process cartridge, as seen from the left side.
Figure 17:
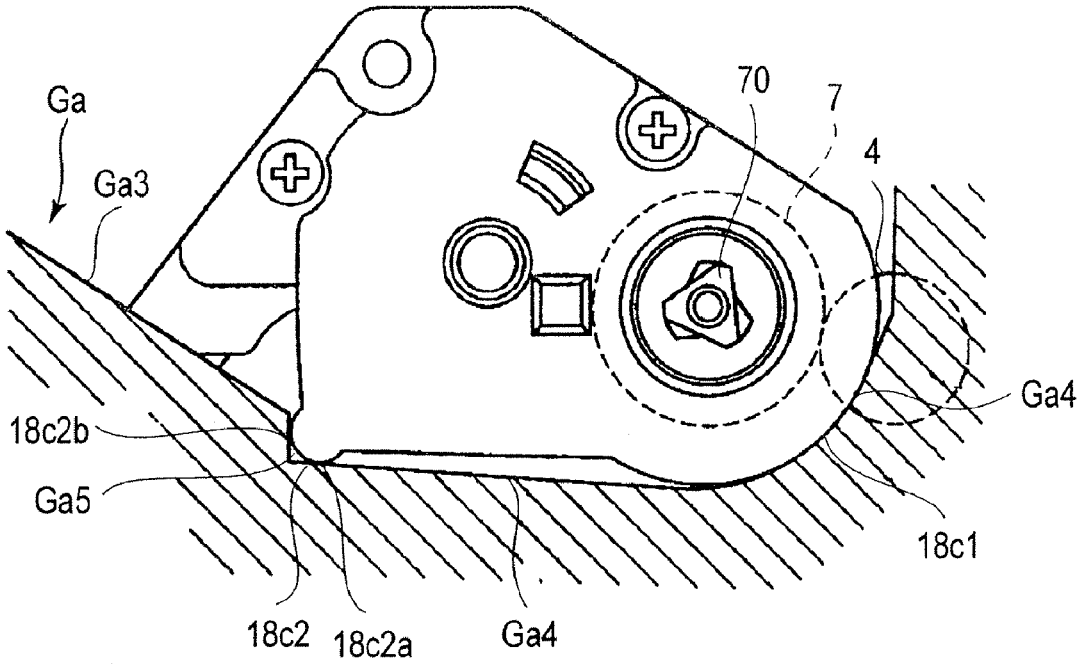
FIG. 17 is a drawing for showing the positioning of the process cartridge relative to the image forming apparatus.

Referring to FIGS. 5, 9, and 17, on the opposite side of the cartridge B from the bearing member 18*c* in terms of the direction parallel to the axial line of the photosensitive drum 7, there are a cartridge positioning member 18*b* and a projection 11*g*, which are parts of the cleaning means frame 11*d*. The positioning portion 18*b* covers the drum supporting shaft 18*d*, and the projection 11*g* controls the attitudes of the process cartridge B when the cartridge B is mounted or dismounted.

Next, referring to FIGS. 16 and 17, the main assembly of the image forming apparatus A is provided with a guiding member Gb, which controls the attitude of the cartridge B, from the opposite side of the cartridge B from the bearing member 18*c*, in terms of the direction parallel to the axial line of the photosensitive drum 7, preventing the cartridge B from becoming tilted relative to the axial line of the photosensitive drum 7, while the cartridge B is mounted or dismounted.

Next, referring to FIGS. 15-20, how the cartridge B is mounted into the main assembly of the image forming apparatus A, or removed therefrom, will be described.

First, a hinged door (unshown), which covers the opening 6 of the main assembly of the image forming apparatus A, is to be opened to expose the guiding members Ga and Gb. Then, the cartridge B is to be inserted into the main assembly, with the cartridge B oriented so that its guiding portion 18*c*1 (FIG. 4) in the form of an arc (FIG. 4) and its rotation controlling portion 18*c*2 are on the front and rear sides, respectively, in terms of the cartridge insertion direction, and rest on the first guiding surface Ga1 of the guiding member Ga, which is the entry portion of the guiding member Ga, and is slightly bent at the front end in terms of the cartridge insertion direction. As for the guiding member Gb, as the cartridge B is inserted in the manner described above, the positioning portion 18*b* and projection 11*g* of the process cartridge B come into contact with the first guiding surface Gb1 of the guiding member Gb.

Then, the cartridge B is to be inserted deeper into the main assembly of the image forming apparatus A. As the cartridge B is inserted deeper, the process cartridge B is slid into the image forming position, with the guiding portion 18*c*1 and rotation controlling portion 18*c*2 of the cartridge B guided by the second guiding surface Ga2, the third guiding surface Ga3, and the fourth guiding surface Ga4, shown in FIG. 15. The second guiding surface Ga2 roughly perpendicularly extends from the first guiding surface Ga1, and the third guiding surface Ga3 roughly horizontally extends from the second guiding surface Ga2. The fourth guiding surface Ga4 is curved.

Therefore, the guiding portion 18*c*1 of the cartridge B comes into contact with the fourth guiding surface Ga4, as the first cartridge catching portion, of the main assembly, which precisely positions the cartridge B relative to the main assembly of the image forming apparatus A at the end of the mounting of the cartridge B, as shown in FIG. 17, and at the same time, the bottom portion 18*c*2*a* of the curved rotation controlling portion 18*c*2 comes into contact with the fourth guiding surface Ga4. Also at the end of the mounting of the cartridge B into the main assembly of the image forming apparatus A, the transfer roller 4 comes into contact with the photosensitive drum 7, and the cartridge B comes, and remains, under the reactive pressure generated in the direction indicated by an arrow mark by the contact pressure generated between the transfer roller 4 and photosensitive drum 7 by the placement of the cartridge B into the image forming position. Further, the rear portion 18*c*2*b* of the curved rotation controlling portion 18*c*2 comes into contact with the fifth guiding surface Ga5, which is on the upstream side of the third guiding surface Ga3 in terms of the cartridge insertion direction, regulating thereby the distance by which the cartridge B is allowed to move in the above-mentioned direction indicated by the arrow mark, to a predetermined value. The rear and bottom portions 18*c*2*b* and 18*c*2*a*, respectively, of the curved rotation controlling portion 18*c*2 may be integral with each other as in this embodiment, or may be independent from each other.

As for the positioning portion 18*b* and projection 11*g*, which are located on the opposite side of the cartridge B from the above described components, in terms of the direction parallel to the axial line of the photosensitive drum 7, they are guided by the second guiding surface Gb2 extending from the first guiding surface Gb1, the third guiding surface Gb3 extending from the second guiding surface Gb2, the fourth guiding surface Gb4 extending from the third guiding surface Gb3, shown in FIG. 19, while sliding thereon, until the cartridge B is precisely placed in the image forming position. At the completion of the mounting of the cartridge B, the positioning guide 18*b* is on the positioning portion Gb5 of the guiding surface Gb.

Through the above described steps, the process cartridge B is placed in the image forming position in the main assembly of the image forming apparatus A.

Next, the hinged door (unshown), which is covering the opening 6 of the main assembly of the image forming apparatus A, is to be closed. As the door is closed, the driving force transmitting member 300 (FIG. 15) of the main assembly of the image forming apparatus A, which has a twisted hole 300*a* having a triangular cross section, is moved toward the cartridge B, and engages with the coupling 70 (FIG. 17) of the cartridge B, making it thereby possible for the rotational driving force to be transmitted from the main assembly of the image forming apparatus A to the cartridge B. As for the shape of the coupling 70, it is in the form of a twisted projection, which is triangular in cross section so that the coupling 70 is allowed to fit into the hole 300*a*. As the driving force is transmitted from the driving force transmitting member 300 to the coupling 70 (twisted projection) in the hole 300*a* of the driving force transmitting member 300, the coupling 70 is pulled deeper into the driving force transmitting member 300. As a result, the position of the photosensitive drum 7 in terms of the lengthwise direction becomes fixed.

Incidentally, if the portion 200*a* of the protective member 200 is left attached to the cartridge B, even if the hinged door (unshown) is closed, the projection 70 (coupling) is not allowed to enter the hole 300*a* of the driving force transmitting member 300, because of the presence of the portion 200*a* between the outward edge of the hole 300*a* and the end surface of the projection 70.

Figure 18:
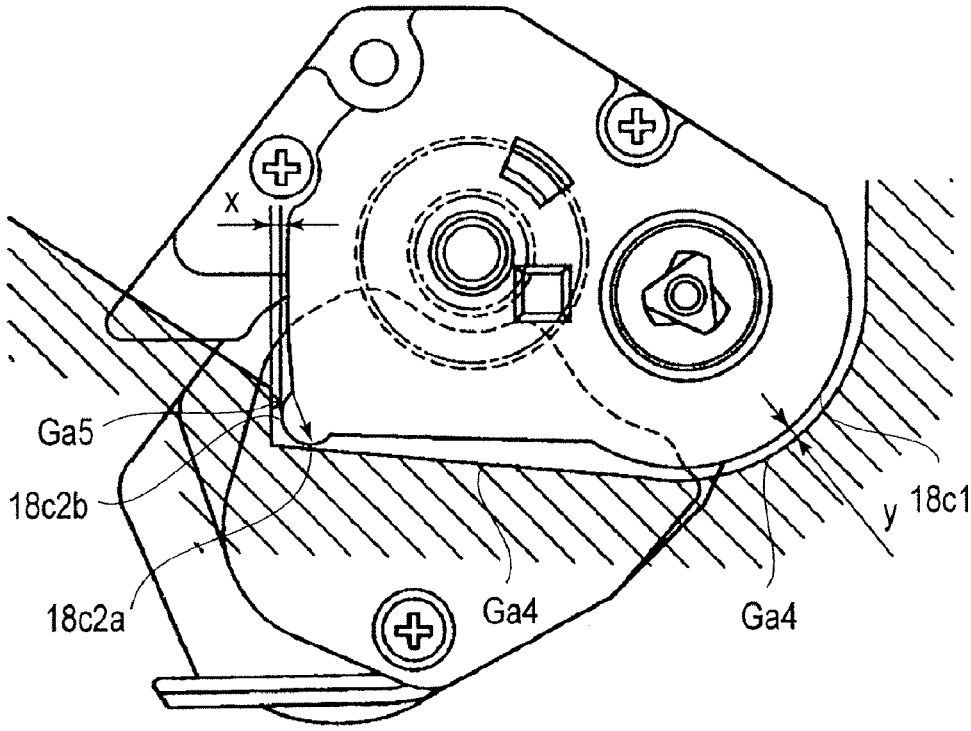
FIG. 18 is a drawing for showing the positioning of the process cartridge relative to the image forming apparatus.

Referring to FIG. 18, at the point in time when the driving force transmitting member 300 of the main assembly of the image forming apparatus A finishes engaging with the coupling 70 of the cartridge B, a gap (y) is created between the curved guiding portion 18*c*1 and fourth guiding surface Ga4, and a gap (x) is formed between the rear portion 18*c*2*b* of the rotational controlling portion 18*c*2, and the fifth guiding surface Ga5. Further, as the driving force is transmitted, the process cartridge B is pressured in the rotational direction of the photosensitive drum 7. Therefore, the position of the process cartridge B becomes fixed, in terms of the rotational direction of the process cartridge B, with the bottom portion 18*c*2*a* of the curved rotation controlling portion 18*c*2 remaining in contact with the fourth guiding surface Ga4.

Referring to FIG. 19, as for the positioning portion 18*b*, which is at the opposite end of the process cartridge B in terms of the axial line of the photosensitive drum 7, it settles in the U-shaped groove as a positioning portion, which is a part of the fourth guiding surface Gb4, as the process cartridge B is mounted into the main assembly of the image forming apparatus A. After settling in the groove, it remains fixed in position by a pressure applying member 400 in the form of a torsional coil spring, in order to control the reactive force from the transfer roller 4, and the vibrations which occur as the photosensitive drum 7 is rotationally driven. The projection 11*g* is shaped and positioned so that it does not come into contact with the main assembly of the image forming apparatus A, provided that the dimensions of the projection 11*g* and the components related thereto are within the tolerance.

Figure 22:
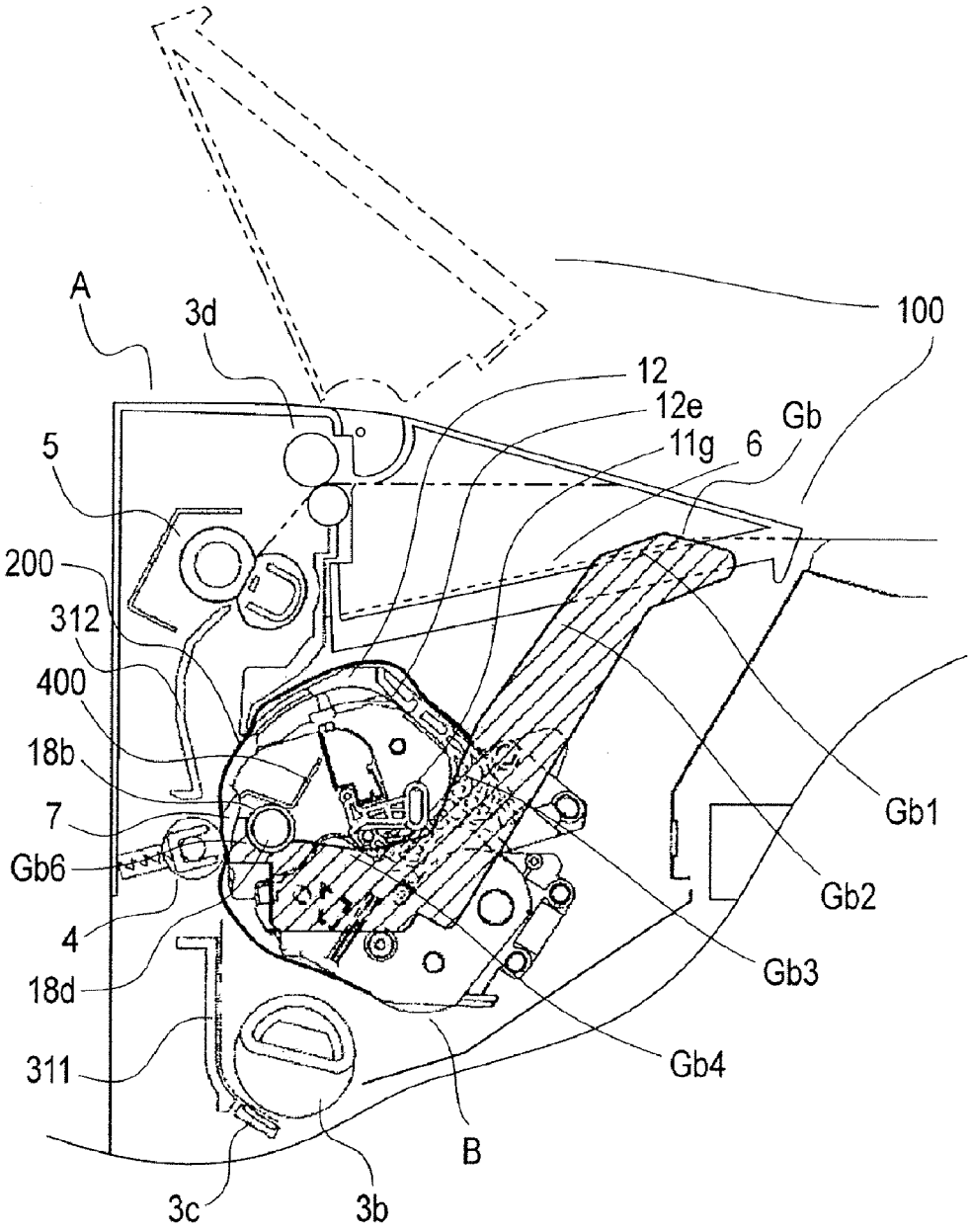
FIG. 22 is a right side view illustrating the process cartridge completely mounted to the apparatus.

Also during the aforementioned mounting of the cartridge B into the main assembly of the image forming apparatus A, the projection 12*e* (rib) of the drum shutter 12 comes into contact with the first shutter guiding surface Gb7, which is a portion of the guide Gb. Then, as the cartridge B is further inserted, with the projection 12*e* remaining in contact with the shutter guiding surface Gb7, the projection 12*e* causes the drum shutter 12 to begin to be rotated about its rotational axes 12*b*1 and 12*b*2. As the process cartridge B is further inserted, the projection 12*e* of the drum shutter 12 is moved, while sliding on the shutter guiding second surface Gb8, as indicated by the single-dot chain line, and moving the drum shutter 12 into its final position shown in FIGS. 1 and 2, into the final position, in which it contacts the shutter guiding third surface Gb9. Then, it is contacted to the guiding surface Gb9 to move the drum shutter 12 to the exposing position as shown in FIG. 22 to expose the photosensitive drum 7. However, since the cartridge B is provided with the protective member 200, the photosensitive drum 7 and the transfer roller 4 are not directly contacted to each other, as shown in FIG. 22. Thus, the apparatus can be transported in the state in which the process cartridge B having the protection member 200 is mounted to the main assembly A of the apparatus (completion of the mounting of the process cartridge).

The attitude of the cartridge B in the above described position in which the cartridge B is placed at the end of the mounting of the cartridge B into the main assembly of the image forming apparatus A is the attitude in which the cartridge is held in which an image is formed, and also, while the cartridge B is shipped in the main assembly of the image forming apparatus A.

When extracting the process cartridge B from the main assembly of the image forming apparatus A, the process cartridge B is to be pulled out of the main assembly, along the guides Ga and Gb of the main assembly, following in reverse the above described steps taken to mount the process cartridge B into the main assembly. As the process cartridge B is pulled out of main assembly, the drum shutter 12 rotates in the direction opposite to the direction in which it is rotated when mounting the process cartridge B into the main assembly.

Also when removing the process cartridge B from the main assembly of the image forming apparatus A, the projection 11*g* comes into contact with the sixth guiding surface Gb6 of the guiding member Gb, preventing thereby the leading end of the process cartridge B in terms of the cartridge removal direction from rotating upward no less than a predetermined distance.

Although this embodiment was described above with reference to the process cartridge for the monochromatic image forming apparatus, the present invention is also applicable, with good results, to a process cartridge for an image forming apparatus which employs a plurality of process cartridges and is capable of forming plural types of image (for example, two-tone image, tri-tone image, full-color image, etc.).

As described above, the protective means, in this embodiment, for protecting the driving force transmitting portion, the photosensitive drum, and the transferring means, across the areas which would be in contact with the corresponding components if the above described structural arrangement were not put in place, from the vibrations and impacts which occur during shipment, can protect these portions without interfering with the movement of the drum shutter for protecting the photosensitive drum. Therefore, this protective means makes it possible to transport an image forming apparatus, with the process cartridge placed in the image forming position in the main assembly of the image forming apparatus. In other words, this embodiment makes it possible to transport an image forming apparatus, with a single or plurality of processing units positioned in the main assembly of the image forming apparatus, making it possible to not only reduce the amount of the shipment materials such as boxes, wrapping, etc., but also, improve the image forming apparatus in shipment efficiency.

As the photosensitive substance for the electrophotographic photosensitive member (photosensitive drum in the above described embodiment), amorphous silicon, amorphous selenium, zinc oxide, titanium oxide, organic photoconductor, etc., are usable. As for the shape of the electrophotographic photosensitive member, the electrophotographic photosensitive member does not need to be in the form of a drum; it may be in the form of a belt, for example. Further, when employing an electrophotographic photosensitive member in the form of a drum, it may be formed by coating or depositing a photoconductive substance on the peripheral surface of a cylinder formed of aluminum alloy or the like.

As for the developing method, any of the well-known developing methods may be used; for example, the two-component magnetic brush developing method, the cascade developing method, the touch-down developing method, the cloud developing method, and the like.

As for the structure of the charging means, the charging method in the above described embodiment was the so-called direct charging method. However, the present invention is also compatible with various conventional charging methods other than the direct charging method; for example, the method in which a piece of tungsten wire is surrounded on three sides with an aluminum shield or the like, and the positive or negative ions generated by applying high voltage to the tungsten wire are transferred onto the peripheral surface of the photosensitive drum to uniformly charge the peripheral surface of the photosensitive drum, may be employed. Regarding the contact charging method, the charging means may be in the form of a blade (charge blade), a pad, a block, a rod, or a piece of wire, or the like, instead of the above described roller.

A process cartridge is a cartridge comprising an electrophotographic photosensitive member, and at least one of the processing means. Thus, a process cartridge may be a cartridge in which an electrophotographic photosensitive member and a developing means are integrally disposed, and which is removably mountable in the main assembly of an electrophotographic image forming apparatus, or a cartridge in which an electrophotographic photosensitive member, a developing means, and a charging means or a cleaning means, are integrally disposed, and which is removably mountable in the main assembly of an electrophotographic image forming apparatus, etc., in addition to the process cartridge in this embodiment. A process cartridge can be mounted into the main assembly of an image forming apparatus by a user himself, making it thereby possible for a user to maintain an image forming apparatus by himself.

Further, in this embodiment, the electrophotographic image forming apparatus is in the form of a laser beam printer. However, the application of the present invention is not limited to a laser beam printer. For example, the present invention is also applicable to various electrophotographic image forming apparatuses other than a laser beam printer; for example, an electrophotographic printer such as an electrophotographic copying machine, an LED printer, etc., a facsimile machine, a word processor, and a multifunction printer capable of functioning as two or more of the preceding apparatuses.

Embodiment 2

Next, the second embodiment of the present invention will be described. The structural components in this embodiment similar to those in the first embodiment will be given the same referential symbols as those given for the description of the first embodiment, and will not be described in detail.

Figure 20:
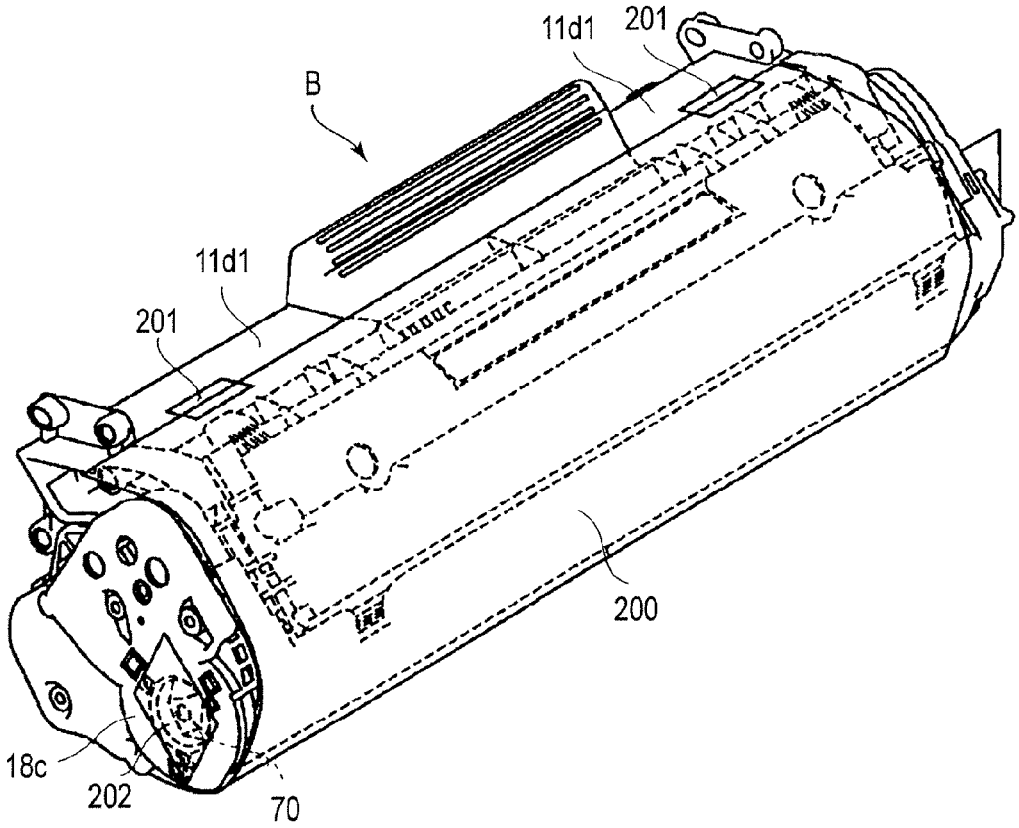
FIG. 20 is a perspective view of the process cartridge fitted with the protective member, in another embodiment of the present invention.

Referring to FIG. 20, the protective member 201 comprises: a portion which will be between the photosensitive drum 7 and transfer roller 4 after the mounting of the process cartridge into the main assembly of an image forming apparatus A; a portion which will be between the second gear 73 and transfer gear 4*a* after the mounting of the process cartridge; and a portion which will be between the coupling 70 and the driving force transmitting member 300 (FIG. 15) after the mounting of the process cartridge. The portion which will be between the coupling 70 and driving force transmitting member 300 may be provided as a second protective member 202 separate from the first protective member 201, and may be a piece of adhesive tape.

Figure 21:
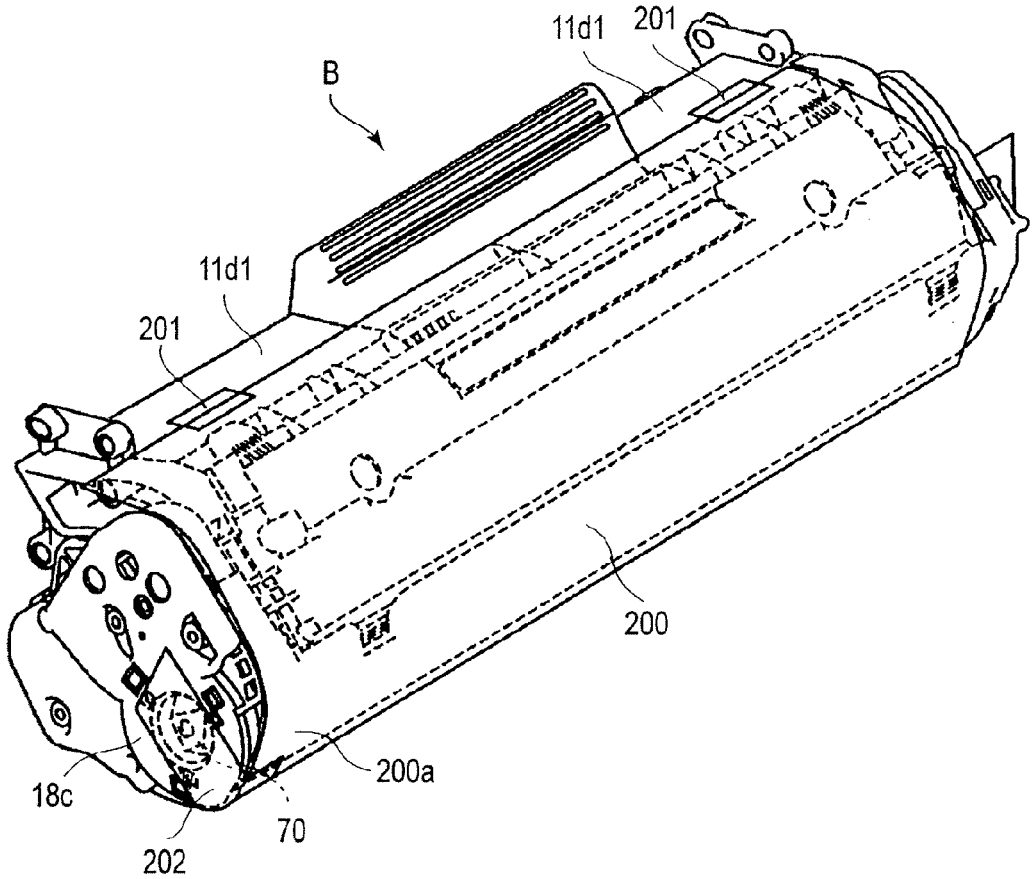
FIG. 21 is a perspective view of the process cartridge fitted with the protective member, in yet another embodiment of the present invention.

Referring to FIG. 21, the second protective member 202 is formed of adhesive tape. It is adhered to the bearing member 18*c*, being extended from the upstream side of the coupling 70 toward downstream side, in terms of the cartridge insertion direction, wrapped around the corner between the side wall of the cartridge and the downstream side wall of the cartridge, and attached to the adjacencies 200*a* of the corner, which opposes the peripheral surface of the photosensitive drum 7 within the cartridge.

In the above described first and second embodiments, the protective members 200 and 201, respectively, more specifically, the portions 200*a* and 202, are positioned between the coupling 70 and the driving force transmitting member 300. In some cases, the protective member 200 may be structured so that it protects only the photosensitive drum 7.

As described above, according to the present invention, when shipping an electrophotographic image forming apparatus in which a single or plurality of process cartridges have been mounted in the image forming position, the photosensitive drums and transfer rollers are well protected.

In other words, the present invention makes it possible to leave a process cartridge in the main assembly of an image forming apparatus when shipping in combination the process cartridge and the image forming apparatus. Therefore, the present invention makes it possible to reduce the amount of the shipment materials such as the shipment carton and the shipment wrapping, and also, to improve an image forming apparatus in terms of shipment efficiency.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 024324/2004 and 016151/2005 filed Jan. 30, 2004 and Jan. 24, 2005, respectively, which is hereby incorporated by reference.

What is claimed is:

1. An electrophotographic image forming apparatus for forming an image on a recording material, wherein said electrophotographic image forming apparatus is transportable with a process cartridge set thereto, said apparatus comprising:

(i) a transfer roller configured and positioned to transfer a toner image onto the recording material and provided in a main assembly of said apparatus;

(ii) said process cartridge detachably mountable to said apparatus, said process cartridge comprising:

a frame;

an electrophotographic photosensitive drum;

process means actable on said electrophotographic photosensitive drum;

a protection shutter movable between an exposing position for opening an opening provided in said frame to expose said electrophotographic photosensitive drum, and a protecting position for closing said opening to protect said electrophotographic photosensitive drum; and a protecting member interposable between said electrophotographic photosensitive drum and said transfer roller, upon transportation of said process cartridge set in the main assembly of the apparatus together with the main assembly, wherein said protecting member is mounted on said frame to cover said protection shutter such that said protection shutter is movable from the protecting position to the exposing position in interrelation with mounting of said process cartridge to the main assembly of the apparatus;

(iii) mounting means for mounting said process cartridge; and (iv) feeding means for feeding the recording material.

2. An apparatus according to claim 1, wherein said protecting member includes a flexible resin material sheet.

3. An apparatus according to claim 1, wherein said protection shutter has an engaging portion configured and positioned to engage a main assembly engaging portion provided in the main assembly of said apparatus upon mounting of said process cartridge to said main assembly of said apparatus.

4. An apparatus according to claim 1, wherein a gap is provided between said protecting member and a surface of said frame to permit movement of said protection shutter from the protecting position to the exposing position.

5. An apparatus according to claim 1, wherein said protecting member covers at least a portion where said electrophotographic photosensitive member contacts said transfer roller during image formation, with respect to a longitudinal direction of said electrophotographic photosensitive member.

* * * * *

UNITED STATES PATENT AND TRADEMARK OFFICE

CERTIFICATE OF CORRECTION

PATENT NO. : 7,283,766 B2
APPLICATION NO. : 11/465746
DATED : October 16, 2007
INVENTOR(S) : Takeshi Arimitsu et al.

It is certified that error appears in the above-identified patent and that said Letters Patent is hereby corrected as shown below:

ON THE COVER PAGE
Item (56), References Cited, Foreign Patent Documents, Page 2, "JP 2000019800 A * ½000" should be deleted.

COLUMN 5
Line 31, "to" should read --to the--.

COLUMN 7
Line 53, "II." should read --11.--.
Line 54, "II," should read --11,--.
Line 58, "II" should read --11--.

Signed and Sealed this

Twenty-seventh Day of January, 2009

JOHN DOLL
*Acting Director of the United States Patent and Trademark Office*